US008047268B1

(12) United States Patent
Kroliczek et al.

(10) Patent No.: US 8,047,268 B1
(45) Date of Patent: Nov. 1, 2011

(54) TWO-PHASE HEAT TRANSFER SYSTEM AND EVAPORATORS AND CONDENSERS FOR USE IN HEAT TRANSFER SYSTEMS

(75) Inventors: Edward J. Kroliczek, Davidsonville, MD (US); Dmitry Khrustalev, Woodstock, MD (US); Michael J. Morgan, Arcanum, OH (US)

(73) Assignee: Alliant Techsystems Inc., Minneapolis, MN (US)

( * ) Notice: Subject to any disclaimer, the term of this patent is extended or adjusted under 35 U.S.C. 154(b) by 1456 days.

(21) Appl. No.: 11/383,953

(22) Filed: May 17, 2006

Related U.S. Application Data

(63) Continuation-in-part of application No. 10/676,265, filed on Oct. 2, 2003.

(60) Provisional application No. 60/681,479, filed on May 17, 2005, provisional application No. 60/415,424, filed on Oct. 2, 2002.

(51) Int. Cl.
*F24D 15/00* (2006.01)

(52) U.S. Cl. ..... 165/104.26; 165/104.21; 165/274

(58) Field of Classification Search ..... 165/104.21, 165/104.26, 274
See application file for complete search history.

(56) References Cited

U.S. PATENT DOCUMENTS

| | | | |
|---|---|---|---|
| 3,490,718 | A | 1/1970 | Vary |
| 3,613,778 | A | 10/1971 | Feldman, Jr. |
| 3,661,202 | A | 5/1972 | Moore, Jr. |
| 3,677,336 | A | 7/1972 | Moore, Jr. |
| 3,734,173 | A | 5/1973 | Moritz |
| 3,756,903 | A | 9/1973 | Jones |
| 3,792,318 | A | 2/1974 | Fries et al. |
| 3,803,688 | A | 4/1974 | Peck |
| 3,884,293 | A | 5/1975 | Pessolano et al. |
| 4,005,297 | A | 1/1977 | Cleaveland |
| 4,046,190 | A | 9/1977 | Marcus et al. |
| 4,087,893 | A | 5/1978 | Sata et al. |
| 4,116,266 | A | 9/1978 | Sawata et al. |
| 4,170,262 | A | 10/1979 | Marcus et al. |
| 4,467,861 | A | 8/1984 | Kiseev et al. |
| 4,470,450 | A | 9/1984 | Bizzell et al. |

(Continued)

FOREIGN PATENT DOCUMENTS

| | | |
|---|---|---|
| DE | 19941398 | 8/2000 |

(Continued)

OTHER PUBLICATIONS

Baumann, Jane, et al., "A methodology for enveloping reliable start-up of LHPs," AIAA Paper 2000-2285 (AIAA Accession No. 33681), AIAA Thermophysics Conference, 34th, Denver, CO, Jun. 19-22, 2000.

(Continued)

*Primary Examiner* — Ljiljana Ciric
(74) *Attorney, Agent, or Firm* — TraskBritt

(57) ABSTRACT

A heat transfer system includes a first loop and a second loop. The first loop includes a condenser having a vapor inlet and a liquid outlet, a vapor line in fluid communication with the vapor inlet of the condenser, a liquid line in fluid communication with the liquid outlet of the condenser, and primary evaporators fluidly coupled in series with the liquid line and in parallel with the vapor line. The second loop includes a reservoir, a secondary evaporator having a vapor outlet coupled to the vapor line and a fluid inlet coupled to the reservoir, and a sweepage line in fluid communication with the reservoir and the primary evaporators.

32 Claims, 27 Drawing Sheets

U.S. PATENT DOCUMENTS

| | | | | |
|---|---|---|---|---|
| 4,470,451 | A * | 9/1984 | Alario et al. | 165/104.26 |
| 4,503,483 | A | 3/1985 | Basiulis | |
| 4,685,512 | A | 8/1987 | Edelstein et al. | |
| 4,770,238 | A | 9/1988 | Owen | |
| 4,819,719 | A | 4/1989 | Grote et al. | |
| 4,854,379 | A | 8/1989 | Shaubach et al. | |
| 4,862,708 | A | 9/1989 | Basiulis | |
| 4,869,313 | A | 9/1989 | Fredley | |
| 4,883,116 | A | 11/1989 | Seidenberg et al. | |
| 4,890,668 | A | 1/1990 | Cima | |
| 4,898,231 | A * | 2/1990 | Miyazaki | 165/274 |
| 4,899,810 | A * | 2/1990 | Fredley | 165/104.26 |
| 4,934,160 | A | 6/1990 | Mueller | |
| 5,002,122 | A | 3/1991 | Sarraf et al. | |
| 5,016,705 | A | 5/1991 | Bahrie et al. | |
| 5,103,897 | A | 4/1992 | Cullimore et al. | |
| 5,303,768 | A | 4/1994 | Alario et al. | |
| 5,335,720 | A | 8/1994 | Ogushi et al. | |
| 5,642,776 | A | 7/1997 | Meyer, IV et al. | |
| 5,725,049 | A | 3/1998 | Swanson et al. | |
| 5,761,037 | A | 6/1998 | Anderson et al. | |
| 5,769,154 | A * | 6/1998 | Adkins et al. | 165/104.26 |
| 5,771,967 | A | 6/1998 | Hyman | |
| 5,816,313 | A | 10/1998 | Baker | |
| 5,842,513 | A | 12/1998 | Maciaszek et al. | |
| 5,899,265 | A | 5/1999 | Schneider et al. | |
| 5,944,092 | A | 8/1999 | Van Oost | |
| 5,947,193 | A * | 9/1999 | Adkins et al. | 165/104.26 |
| 5,950,710 | A | 9/1999 | Liu | |
| 5,966,957 | A | 10/1999 | Malhammar et al. | |
| 6,058,711 | A | 5/2000 | Maciaszek et al. | |
| 6,227,288 | B1 | 5/2001 | Gluck et al. | |
| 6,330,907 | B1 | 12/2001 | Ogushi et al. | |
| 6,381,135 | B1 | 4/2002 | Prasher et al. | |
| 6,382,309 | B1 | 5/2002 | Kroliczek et al. | |
| 6,415,627 | B1 | 7/2002 | Pfister et al. | |
| 6,450,132 | B1 | 9/2002 | Yao et al. | |
| 6,450,162 | B1 | 9/2002 | Wang et al. | |
| 6,533,029 | B1 | 3/2003 | Phillips | |
| 6,591,902 | B1 | 7/2003 | Trent | |
| 6,615,912 | B2 | 9/2003 | Garner | |
| 6,626,231 | B2 | 9/2003 | Cluzet et al. | |
| 6,810,946 | B2 | 11/2004 | Hoang | |
| 6,840,304 | B1 | 1/2005 | Kobayashi et al. | |
| 6,889,754 | B2 | 5/2005 | Kroliczek et al. | |
| 7,004,240 | B1 | 2/2006 | Kroliczek et al. | |
| 7,051,794 | B2 | 5/2006 | Luo | |
| 7,251,889 | B2 | 8/2007 | Kroliczek et al. | |
| 7,549,461 | B2 | 6/2009 | Kroliczek et al. | |
| 7,775,261 | B2 | 8/2010 | Valenzuela | |
| 7,823,629 | B2 | 11/2010 | Rosenfeld et al. | |
| 2002/0062648 | A1 | 5/2002 | Ghoshal | |
| 2003/0051857 | A1 | 3/2003 | Cluzet et al. | |
| 2004/0182550 | A1 | 9/2004 | Kroliczek et al. | |
| 2004/0206479 | A1 | 10/2004 | Kroliczek et al. | |
| 2005/0061487 | A1 | 3/2005 | Kroliczek et al. | |
| 2009/0200006 | A1 | 8/2009 | Kroliczek et al. | |
| 2010/0101762 | A1 | 4/2010 | Kroliczek et al. | |

FOREIGN PATENT DOCUMENTS

| | | | |
|---|---|---|---|
| EP | 0210337 | | 2/1987 |
| EP | 0987509 | A1 | 3/2000 |
| JP | 63036862 | | 3/1988 |
| JP | 2000055577 | | 2/2000 |
| JP | 2000241089 | | 9/2000 |
| RU | 2098733 | | 3/1995 |
| RU | 1834470 | A1 | 7/1995 |
| SU | 505858 | | 5/1976 |
| SU | 1467354 | | 1/1987 |
| WO | 0210661 | A1 | 2/2002 |
| WO | 03054469 | | 7/2003 |
| WO | 2004031675 | | 4/2004 |
| WO | 2004040218 | | 5/2004 |
| WO | 2005043059 | | 5/2005 |

OTHER PUBLICATIONS

Bienert, W.B., et al., "The Proof-of-Feasibility of Multiple Evaporator Loop Heat Pipes," 6th European Symposium on Environmental Systems, May 1997, 6 pages.

Bugby, D., et al., "Across-Gimbal and Miniaturized Cryogenic Loop Heat Pipes," CP654, Space Technology and Applicatons International Forum-STAIF 2003, edited by M.S. El-Genk, American Institute of Physics, 2003, pp. 218-226.

Bugby, D., et al., "Advanced Components and Techniques for Cryogenic Integration," Environmental systems-International conference; 31st Society of Automotive Engineers New York,2001-01-2378, Orlando, FL; (Jul. 2001), 9 pages.

Bugby, D., et al., "Advanced Components and Techniques for Cryogenic Integration," presented at 2002 Spacecraft Thermal Control Symposium by Swales Aerospace, El Segundo, CA, Mar. 2002, 14 pages.

Bugby, D., et al., "Advanced Components for Cryogenic Integration," Cryocoolers 12, edited by R.G. Ross, Jr., Kluwer Academic/Plenum Publishers, 2003, pp. 693-708.

Bugby, D., et al., "Advanced Components for Cryogenic Integration," Proceedings of the 12th International Cryocooler Conference held Jun. 18-20, 2002, in Cambridge, MA, 15 pages.

Bugby, D., et al., "Development and Testing of a Gimbal Thermal Transport System," Proceedings of the 11th International Cryocooler Conference held Jun. 20-22, 2000, in Keystone, Colorado, 11 pages.

Bugby, D., et al., "Development of Advanced Cryogenic Integration Solutions," presented at the 10th International Cryocoolers Conference on May 26-28, 1998, in Monterey, CA, and published in "Cryocoolers 10," by Ron Ross, Jr., Kluwer Academic/Plenum Publishers, NY 1999, 17 pages.

European Search Report (Application No. EP 04 01 6584) dated May 15, 2006 (4 total pages).

Hoang, "Advanced Capillary Pumped Loop (A-CPL) Project Summary," Contract No. NAS5-98103, Mar. 1994, pp. 1-37.

Hoang, Triem T., "Design and Test of a Proof-of-Concept Advanced Capillary Pumped Loop," Society of Automotive Engineers, presented at the 27th Environmental Systems International Conference, New York, 1997, Paper 972326, 6 pages.

Hoang, Trung T., et al., "Development of an Advanced Capillary Pumped Loop," Society of Automotive Engineers, presented at the 27th Environmental Systems International Conference, New York, 1997, Paper 972325, 6 pages.

Kotlyarov, E. Yu, et al., "Methods of Incrase of the Evaporators Reliability for Loop Heat Pipes and Capillary Pumped Loops," 24th International Conference on Environmental Systems, Jun. 20-23, 1994, 15 pages.

Ku, J., "Recent Advances in Capillary Pumped Loop Technology," 1997 National Heat Transfer Conference, Baltimore, MD, Aug. 10-12, 1997, AIAA 97-3870, 22 pages.

Ku, J., et al., "A high power spacecraft thermal management system," AIAA-1988-2702, Thermophysics, Plasmadynamics and Lasers Conference, San Antonio, TX Jun. 27-29, 1988, 12 pages.

Ku, J., et al., "An Improved High Power Hybrid Capillary Pumped Loop," paper submitted to SAE 19th Intersociety Conference on Environment Systems, SAE 891566, San Diego, CA, Jul. 24-27, 1989, 10 pages.

Ku, J., et al., "Testing of a Capillary Pumped Loop with Multiple Parallel Starter Pumps," SAE Paper No. 972329, 1997.

Ku, J., et al., "The Hybrid Capillary Pumped Loop," paper submitted to SAE 18th Intersociety Conference on Environmental Systems, SAE 881083, San Francisco, CA, Jul. 11-13, 1988, 11 pages.

Ku, Jentung, "Operational Characteristics of Loop Heat Pipes," NASA Goddard Space Flight Center; SAE Paper 99-01-2007, 29th International Conference on Environmental Systems, Denver, Colorado, Jul. 12-15, 1999; Society of Automotive Engineers, Inc.

McCabe, Michael E., Jr., et al., "Design and Testing of a High Power Spacecraft Thermal Management System," National Aeronautics and Space Administration (NASA), NASA Technical Memorandum 4051, Scientific and Technical Division, 1988, 107 pages.

O'Connell, et al., "Hydrogen Loop Pipe Design & Test Results," presented at 2002 Spacecraft Thermal Control Symposium by TTH Research, El Segundo, CA, Mar. 2002, 14 pages.

Van Oost et al., "Design and Experimental Results of the HPCPL," ESTEC CPL-96 Workshop, Noordwijk, Netherlands, 1996, 19 pages.
Van Oost, Stephane, et al., "Test Results of Reliable and Very High Capillary Multi-Evaporators/Condenser Loop," 25th International Conference on Environmental Systems, Jul. 10-13, 1995, 12 pages.
Yun, James, et al., "Development of a Cryogenic Loop Heat Pipe (CLHP) for Passive Optical Bench Cooling Applications," 32nd International Conference on Environmental Systems (ICES-2002), Society of Automotive Engineers Paper No. 2002-01-2507, San Antonio, Texas, 2002, 9 pages.
Yun, James, et al., "Multiple Evaporator Loop Heat Pipe," Society of Automotive Engineers, 2000-01-2410, 30th International Conference on Environmental Systems, Jul. 10-13, 2000, 10 pages.
Yun, S., et al., "Design and Test Results of Multi-Evaporator Loop Heat Pipes," SAE Paper No. 1999-01-2051, 29th International Conference on Environmental Systems, Jul. 1999, 7 pages.
International Search Report of PCT/US03/031110, dated Feb. 16, 2004.
PCT International Preliminary Examination Report (Application No. PCT/US03/34165) mailed Mar. 8, 2007, 3 total pages.

* cited by examiner

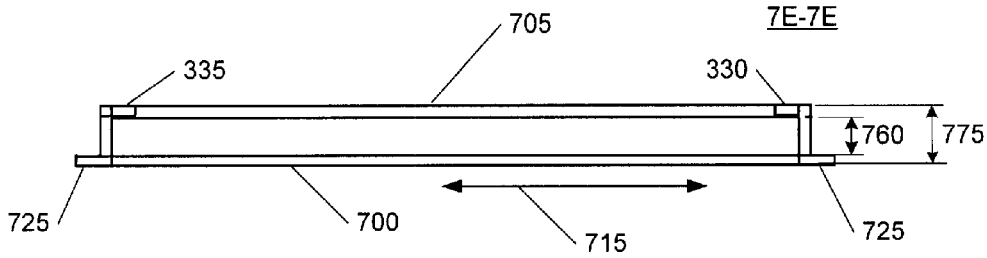
Fig. 7E
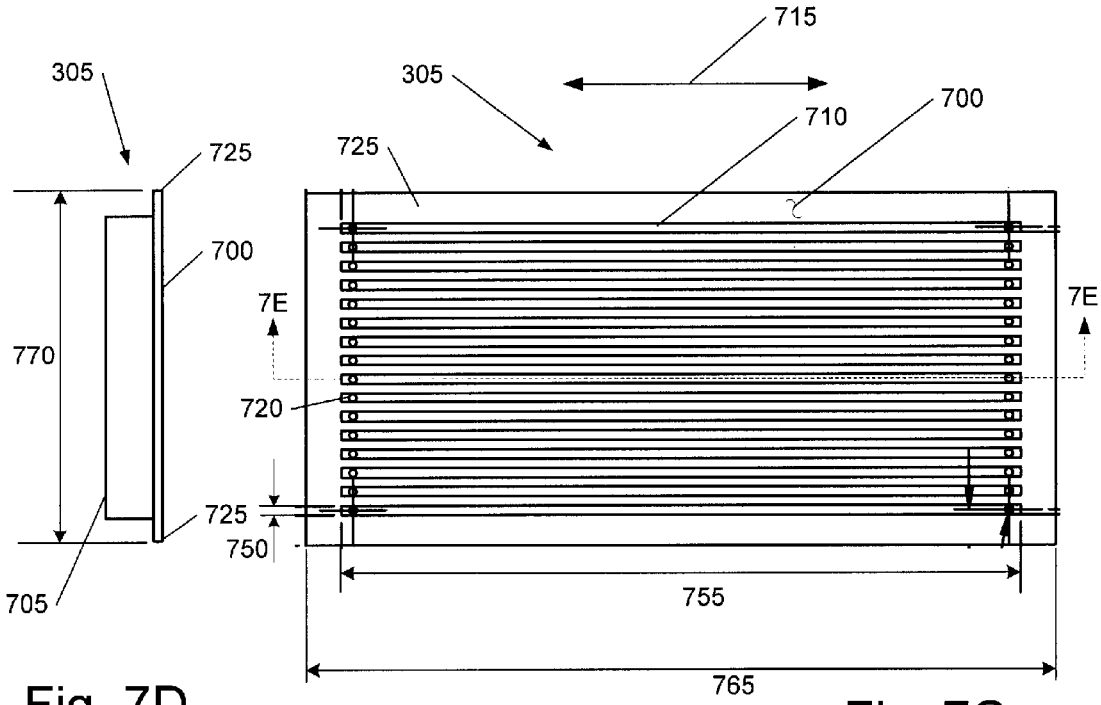
Fig. 7D
Fig. 7C

TWO-PHASE HEAT TRANSFER SYSTEM AND EVAPORATORS AND CONDENSERS FOR USE IN HEAT TRANSFER SYSTEMS

CROSS-REFERENCE TO RELATED APPLICATIONS

This application claims the benefit of U.S. Provisional Application Ser. No. 60/681,479, filed May 17, 2005, and is a continuation-in-part of U.S. patent application Ser. No. 10/676,265, filed Oct. 2, 2003, which claimed the benefit of U.S. Provisional Application Ser. No. 60/415,424, filed Oct. 2, 2002. The disclosure of each of these applications is incorporated herein by reference in its entirety.

This application is also related to U.S. application Ser. No. 10/602,022, filed Jun. 24, 2003, now U.S. Pat. No. 7,004,240, which claimed the benefit of U.S. Provisional Application Ser. No. 60/391,006 filed Jun. 24, 2002; U.S. application Ser. No. 09/896,561, filed Jun. 29, 2001, now U.S. Pat. No. 6,889,754, which claimed the benefit of U.S. Provisional Application Ser. No. 60/215,588 filed Jun. 30, 2000; and U.S. application Ser. No. 11/383,740, filed May 16, 2006 now U.S. Pat. No. 7,931,072, issued Apr. 26, 2011.

TECHNICAL FIELD

This description relates to a two-phase heat transfer system and its components.

BACKGROUND

Heat transfer systems are used to transport heat from one location (the heat source) to another location (the heat sink). Heat transfer systems can be used in terrestrial or non-terrestrial applications. For example, heat transfer systems can be used in electronic equipment, which often require cooling during operation. Heat transfer systems can also be used in, and integrated with, satellite equipment that operates within zero or low-gravity environments.

Loop Heat Pipes (LHPs) and Capillary Pumped Loops (CPLs) are examples of passive two-phase loop heat transfer systems. Each includes an evaporator thermally coupled to the heat source, a condenser thermally coupled to the heat sink, fluid that flows between the evaporator and the condenser, and a fluid reservoir for accommodating redistribution or volume changes of the fluid and for heat transfer system temperature control. The fluid within the heat transfer system can be referred to as the "working fluid." The evaporator includes a wick that enables liquid flow. Heat acquired by the evaporator is transported to and rejected by the condenser. These systems utilize capillary pressure developed in a fine-pored wick within the evaporator to promote circulation of working fluid from the evaporator to the condenser and back to the evaporator.

SUMMARY

In one general aspect, a heat transfer system includes a first loop and a second loop. The first loop includes a condenser including a vapor inlet and a liquid outlet, a vapor line in fluid communication with the vapor inlet of the condenser, a liquid line in fluid communication with the liquid outlet of the condenser, and primary evaporators fluidly coupled in series with the liquid line and in parallel with the vapor line. The second loop includes a reservoir, a secondary evaporator having a vapor outlet coupled to the vapor line and a fluid inlet coupled to the reservoir, and a sweepage line in fluid communication with the reservoir and the primary evaporators.

Implementations can include one or more of the following aspects. For example, each of the primary evaporators can include a vapor outlet, a fluid inlet, and a fluid outlet. The vapor line can fluidly couple the vapor inlet of the condenser with the vapor outlets of each of the primary evaporators. The liquid line can fluidly couple the liquid outlet of the condenser with the fluid inlet of one of the primary evaporators.

The first loop and/or the second loop can include a coupling line that couples a fluid outlet of one of the primary evaporators to a fluid inlet of another of the primary evaporators.

The first loop and/or the second loop can include a coupling line that fluidly couples at least two of the primary evaporators. The coupling line and the liquid line can be thermally linked.

In another general aspect, a heat transfer system includes a first evaporator including a fluid inlet and a fluid outlet; a second evaporator including a fluid inlet; a condenser including a liquid outlet and a vapor inlet fluidly coupled to one or both of the first evaporator and the second evaporator; a coupling line providing fluid communication between the fluid outlet of the first evaporator and the fluid inlet of the second evaporator; and a liquid line providing fluid communication between the liquid outlet of the condenser and the fluid inlet of the first evaporator and being thermally linked with the coupling line.

Implementations can include one or more of the following features. For example, the heat transfer system can include a secondary system. The secondary system can include a reservoir, a secondary evaporator fluidly linked to the reservoir and to the vapor line, and a sweepage line providing fluid communication between the reservoir and a fluid outlet of the second evaporator.

The vapor inlet of the condenser can be coupled to only one of the first and second evaporators. The vapor inlet of the condenser can be coupled to both the first and second evaporators.

The liquid line can be thermally linked with the coupling line by a bond between a tube of the liquid line and a tube of the coupling line. The liquid line can be thermally linked with the coupling line such that the liquid line is at least partially inside the coupling line.

In another general aspect, a condenser includes a housing defining channels extending along an axial direction, a vapor inlet fluidly coupled to the channels, a liquid outlet fluidly coupled to the channels, and a porous structure fluidly coupled to two or more channels defined by the housing and to the liquid outlet, and having a pore size large enough to permit liquid to flow from the two or more channels through the liquid outlet.

Implementations can include one or more of the following features. For example, the channels defined by the housing can be microchannels, that is, channels that have depths and widths on the order of a micron.

The porous structure can extend in a direction that is perpendicular to an axial direction. The porous structure can extend across all channels of the housing such that the porous structure fluidly couples to all channels. The porous structure can be positioned between the two or more channels and the liquid outlet.

The porous structure can be inside the housing. The porous structure can have a pore size that is small enough to generate a capillary pressure of a same order of magnitude as a pressure drop across the channel defined within the housing.

In another general aspect, an evaporator includes an outer enclosure, a liquid inlet coupled through the outer enclosure, a vapor outlet coupled through the outer enclosure, and a wick within the outer enclosure, fluidly coupled to the liquid inlet, extending along an axial direction, and having an outer surface adjacent the outer enclosure. The wick defines or includes a circumferential groove between the outer enclosure and the wick outer surface. The circumferential groove extends in a direction that is non-parallel to the axial direction. The wick defines or includes a channel that is fluidly connected to the circumferential groove, and that extends along the axial direction of the wick, and is coupled to the vapor outlet.

Implementations can include one or more of the following features. For example, the circumferential groove can extend perpendicularly to the axial direction.

The evaporator can include a plurality of circumferential grooves that are fluidly coupled to each other only through the wick channel. The circumferential groove can be formed along an outer surface of the wick. The circumferential groove can be formed as a continuous spiral.

The wick can define or include a plurality of channels fluidly connected to the circumferential groove. The outer enclosure can include a heat receiving surface. The plurality of channels can be positioned along an inner circumference of the wick that has a radius less than the radius of the outer circumference of the wick. The plurality of channels can be on the side of the wick near the heat receiving surface. A channel can extend a length of the wick that is less than a total length of the wick as measured along the axial direction.

In another general aspect, an evaporator includes an outer enclosure, a vapor outlet coupled through the outer enclosure, a wick within the outer enclosure and fluidly coupled to the vapor outlet, an end cap bonded to the outer enclosure, contacting the wick, and having a thermal conductivity that is less than the thermal conductivity of the outer enclosure, and a liquid inlet coupled through the end cap to the wick.

Implementations can include one or more of the following features. For example, the evaporator can include a porous structure within the end cap. The porous structure can thermally isolate the wick from the liquid inlet. The porous structure can have a thermal conductivity that is less than a thermal conductivity of the outer enclosure. The porous structure can have pores that are sized to permit liquid flow, but block vapor flow.

In another general aspect, an evaporator includes an outer shell, a vapor outlet extending through or coupling with the outer shell, a liquid inlet extending through or coupling with the outer shell, a wick within the outer shell, fluidly coupled to the vapor outlet, and a porous structure. The porous structure thermally isolates the wick from the liquid inlet, has a thermal conductivity that is less than a thermal conductivity of the outer shell, and has pores sized to permit liquid flow, but block vapor flow.

Implementations can include one or more of the following features. For example, a porous structure can include a liquid distribution groove coupled to the liquid inlet to receive fluid. The outer shell can include an end cap and an outer enclosure. The end cap can be bonded to the outer enclosure, contact the wick, and have a thermal conductivity that is less than the thermal conductivity of the outer enclosure. The liquid inlet can be coupled to or extend through the end cap to the wick.

An evaporator can include a fluid outlet extending through or coupling with the end cap. The porous structure allows liquid to flow inside the end cap along the liquid distribution groove from the liquid inlet to the fluid outlet.

In another general aspect, a system includes an evaporator and a reservoir. The evaporator includes an outer enclosure, a vapor outlet coupled through the outer enclosure, a wick within the outer enclosure and coupled to the vapor outlet, and a porous structure contacting the wick and the outer enclosure. The reservoir includes a reservoir casing and a tube within the reservoir casing that defines a channel that is fluidly coupled to the porous structure of the evaporator. The porous structure thermally isolates the wick from the tube.

Implementations can include one or more of the following features. For example, the porous structure can thermally isolate the wick from a liquid inlet. The porous structure can contact and be positioned within a transition piece that couples a casing of a reservoir to the outer enclosure of the evaporator.

The tube can include an end adjacent the porous structure such that slots are defined between the porous structure and the tube end, and the slots permit vapor flow from the surface of the wick to an expansion volume of the reservoir.

The reservoir can include a porous liner along an inner surface of the reservoir, fluidly contacting the tube and the porous structure. The tube can couple to a liquid inlet of the reservoir.

In another general aspect, a system includes a reservoir having a casing with a first side, a second side, and a linking wall that extends from the first side of the casing to the second side of the casing; and an evaporator fluidly coupled to the reservoir at an opening of the first side. A surface area of the first side is smaller than a surface area of the second side.

Implementations can include one or more of the following features. For example, the first and second sides of the casing can be configured to permit fluid to flow into the evaporator even though the system is tilted relative to a direction in which a gravitational mass exerts a force on the reservoir.

The first and second sides of the casing can be configured to permit fluid to flow into the evaporator even though the system is tilted relative to a vector of gravitational force. The first and second sides can have a circular cross-sectional shape such that the reservoir is conical.

The evaporator can include an outer enclosure that joins with the casing of the reservoir. The evaporator can include a fluid inlet and a vapor outlet, and the reservoir fluidly couples to the fluid inlet. The evaporator can include a porous structure adjacent the fluid inlet and a wick fluidly linked to the vapor outlet and being positioned between the vapor outlet and the porous structure.

Other features and advantages will be apparent from the description, the drawings, and the claims.

DESCRIPTION OF DRAWINGS

FIGS. 7B and 7C are, respectively, bottom and top plan views of the base plate of FIG. 7A;

FIG. 7D is a side plan view of the base plate of FIG. 7A;

FIG. 7E is a cross-sectional view of the base plate of FIG. 7A taken along section line 7E-7E of FIG. 7C;

Like reference symbols in the various drawings indicate like elements.

DETAILED DESCRIPTION

Figure 1:
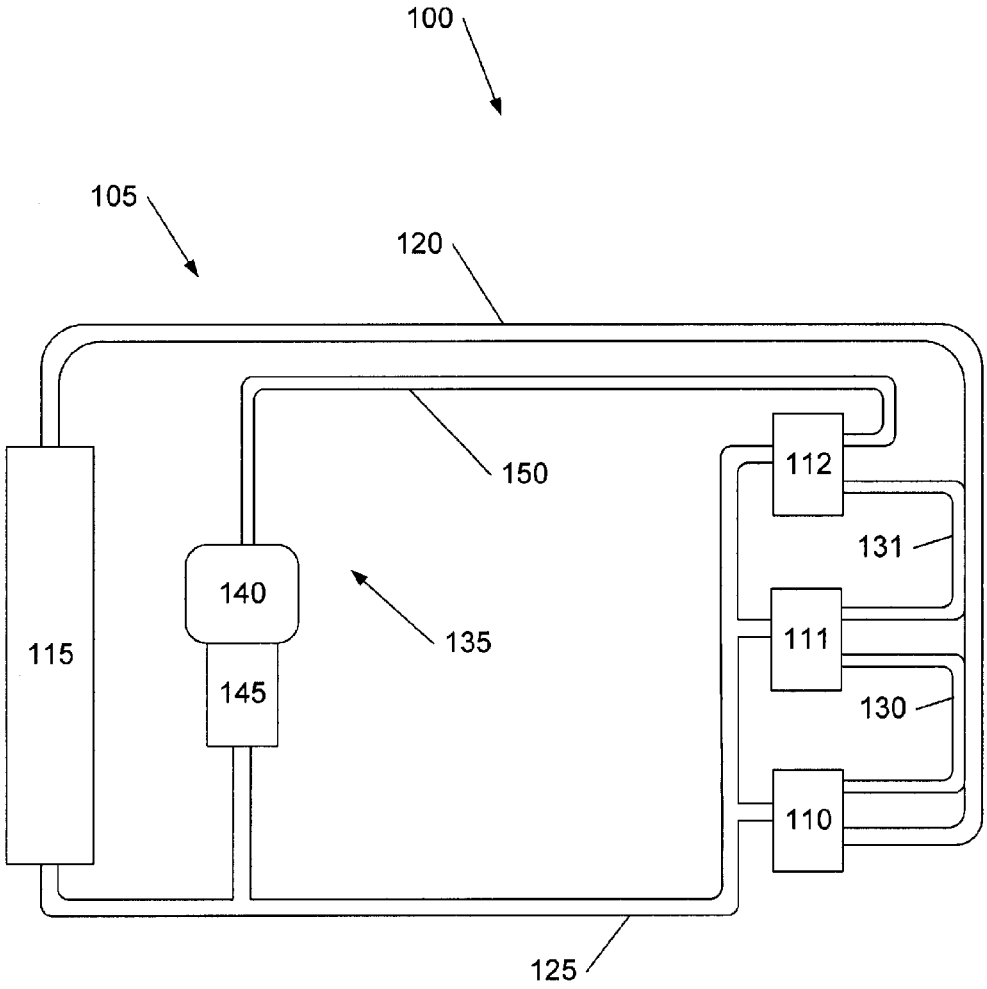
FIG. 1 is a block diagram of a heat transfer system.
Figure 2:
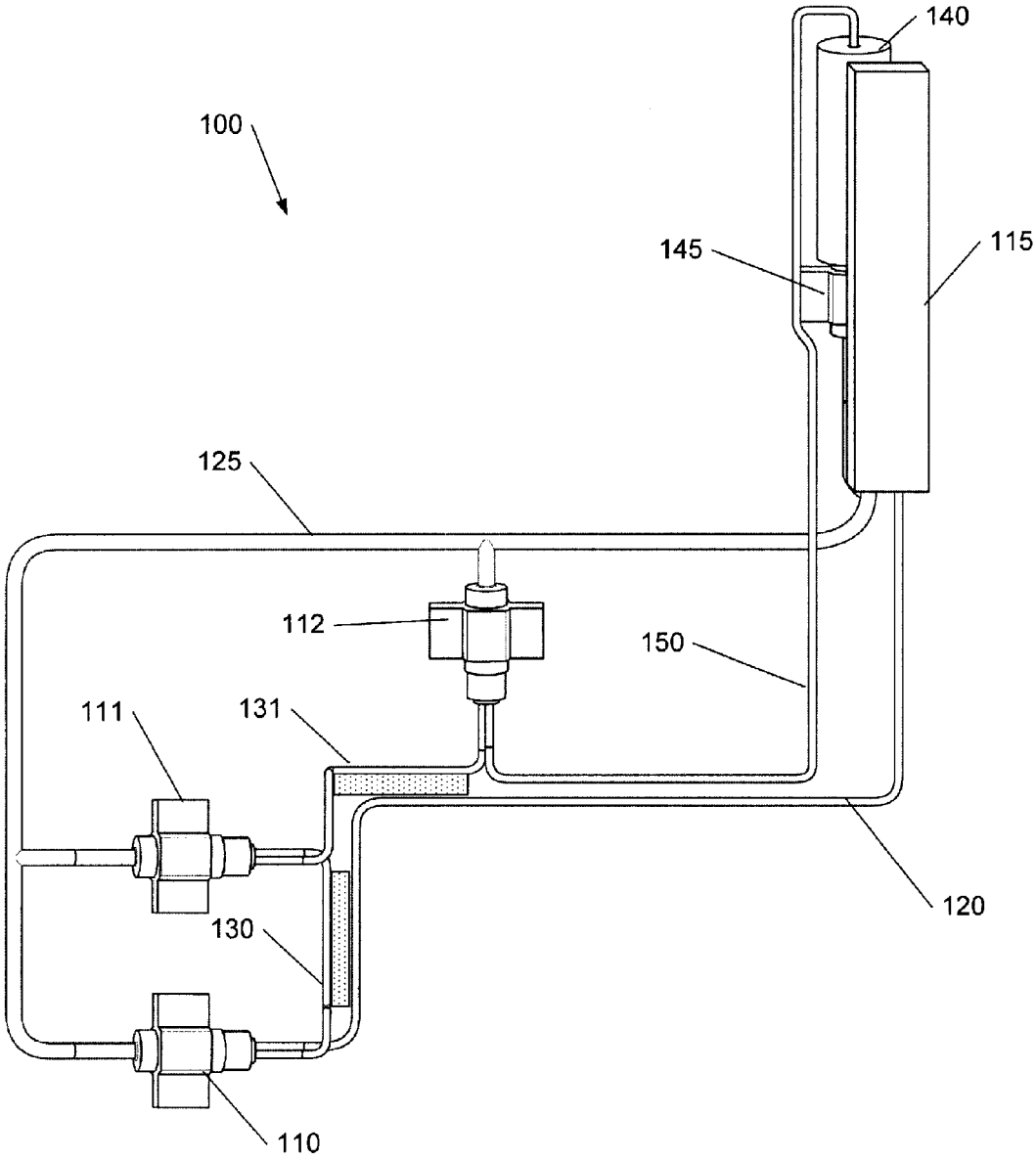
FIG. 2 is a perspective view of the heat transfer system of FIG. 1.

Referring to FIGS. 1 and 2, a heat transfer system 100 includes a first loop 105 including primary evaporators 110, 111, 112, a condenser 115, a liquid line 120 fluidly linking the condenser 115 and the primary evaporators 110, 111, 112, and a vapor line 125 fluidly linking the primary evaporators 110, 111, 112 and the condenser 115. The first loop 105 also includes coupling lines providing fluid communication between each of the primary evaporators. For example, a coupling line 130 provides fluid communication between the primary evaporator 110 and the primary evaporator 111 and a coupling line 131 provides fluid communication between the primary evaporator 111 and the primary evaporator 112. The heat transfer system 100 is suitable for use with water, and the evaporators 110, 111, 112 can be designed to have a high thermal conductivity.

Each of the primary evaporators 110, 111, 112 is thermally coupled to a heat source, the condenser 115 is thermally coupled to a heat sink (not shown), and fluid flows between the primary evaporators 110, 111, 112 and the condenser 115. For example, if the heat transfer system 100 is used in a server environment, then each of the primary evaporators 110, 111, 112 is in thermal contact with a central processing unit (CPU) of the server. The fluid within the heat transfer system 100 can be referred to as the "working fluid," which is able to change phase from a liquid to a vapor and from a vapor to a liquid. As used in this description, the term "fluid" is a generic term that refers to a liquid, a vapor, or a mixture of a liquid and a vapor.

The primary evaporators 110, 111, 112 are connected in series with respect to the liquid flow from the condenser 115 through the liquid line 120. That is, the liquid line 120 couples directly to only one of the primary evaporators, for example, the evaporator 110. The primary evaporator 111 receives fluid that is output from the primary evaporator 110 through the coupling line 130, and the primary evaporator 112 receives fluid that is output from the primary evaporator 111 through the coupling line 131. The primary evaporators 110, 111, 112 are connected in parallel with respect to vapor flow to the condenser 115 through the vapor line 125. That is, each of the primary evaporators 110, 111, 112 is in direct fluid communication with the vapor line 125 to the condenser 115.

The heat transfer system 100 also includes a second loop 135 that includes a reservoir 140, a secondary evaporator 145 in fluid communication with the reservoir 140, and a sweepage line 150. The reservoir 140 is thermally and hydraulically coupled to the secondary evaporator 145. The primary evaporators 110, 111, 112 are connected in series with respect to the fluid flow through the sweepage line 150. That is, the sweepage line 150 provides a direct fluid coupling between the reservoir 140 and one of the primary evaporators, such as the primary evaporator 112.

The second loop 135 ensures that liquid is present in the wick of each the evaporators 110, 111, 112 at start up and provides excess liquid flow to the evaporators 110, 111, 112, such that any vapor bubbles and/or non-condensable gas that forms on the liquid side of the evaporators 110, 111, 112 are removed or swept from the evaporators 110, 111, 112. In particular, during steady-state operation (that is, after start-up of the heat transfer system 100), the secondary evaporator 145 continually sweeps vapor bubbles or non-condensable bubbles from a core of the primary evaporators 110, 111, 112 through the sweepage line 150 and into the reservoir 140. Additionally, during start-up of the heat transfer system 100, the secondary evaporator 145 is initially turned on (for example, by applying heat to a heat receiving surface of the secondary evaporator 145). Then, through capillary pressure developed from the vapor output from the secondary evaporator 145, liquid is pumped into the primary evaporators 110, 111, 112 from the condenser 115 through the liquid line 120, thus ensuring adequate wetting of the wicks in the primary evaporators 110, 111, 112 prior to operation of the primary evaporators 110, 111, 112. In this way, liquid from the reservoir 140 can be pumped to the evaporators 110, 111, 112, thus ensuring that the wicks of the evaporators 110, 111, 112 are sufficiently wetted or "primed" during start-up.

The liquid line 120 from the condenser 115 can be thermally linked with the coupling lines 130, 131 connecting the primary evaporators 110, 111, 112 to more evenly redistribute the sub-cooling of the liquid coming from the condenser 115 between the primary evaporators 110, 111, 112, and to balance back conduction of heat within the heat transfer system 100. For example, the coupling lines 130, 131 can be in the form of tubes and the liquid line 120 can be in the form of a tube, such that the tubes of the coupling lines 130, 131 are in direct thermal contact with the tube of the liquid line 120, as shown in FIG. 1. For example, the tubes of the coupling lines 130, 131 can be in direct contact with the tube of the liquid line 120 and the tubes can be made of a material that permits efficient thermal transfer between the tubes without the need for additional devices to facilitate thermal transfer. As another example, one or more thermally conductive devices can be placed between the tubes of the coupling lines 130, 131 and the tube of the liquid line 120 to contacts the tubes, as shown in FIG. 2. For example, the tubes of the coupling lines 130, 131 can be soldered, brazed, or welded to the tubes of the liquid line 120. As a further example, parts of the liquid return line 120 can be inserted into and bonded to (by brazing or welding) the tubes of the coupling lines 130, 131 to form a counter-flow tube-in-tube heat exchanger.

Referring to FIGS. 3A-3G, in one implementation, the condenser 115 includes a lid 300, a base plate 305, an inlet fitting 310, and an outlet fitting 315 that connects with the base plate 305. The lid 300 couples with an external heat exchanger or a heat sink (not shown). The condenser 115 also includes a flow regulator 320 integrated between the outlet fitting 315 and the base plate 305. The base plate 305 mates with the lid 300, the inlet fitting 310 mates with the base plate 305, and the outlet fitting 315 mates with the base plate 305 to form a hermetically sealed fluid enclosure that only permits fluid to flow out the condenser 115 through an outlet port 317 of the outlet fitting 315 or into the condenser 115 through an inlet port 312 of the inlet fitting 310.

The lid 300, the base plate 305, and the inlet and outlet fittings 310, 315, respectively, can be made of any suitable material that can maintain fluid within the enclosure, such as, for example, metal, ceramic, or plastic. In one implementation, the lid 300, the base plate 305, and the fittings 310, 315 are made of copper.

Figure 5A:
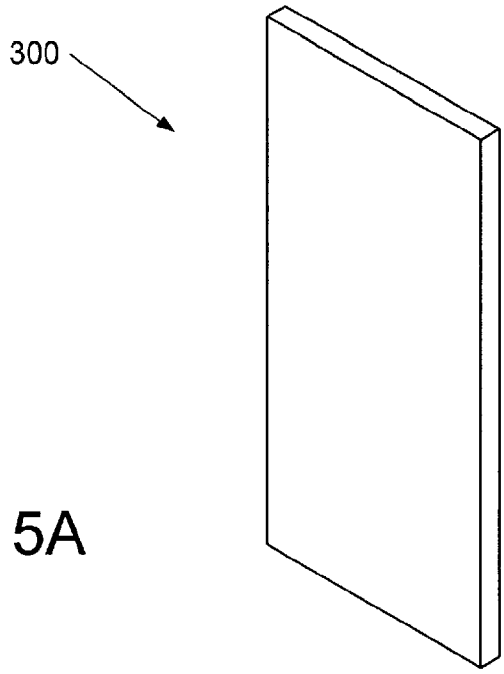
FIG. 5A is a perspective view of a lid of the condenser of FIG. 3A.
Figure 5B:
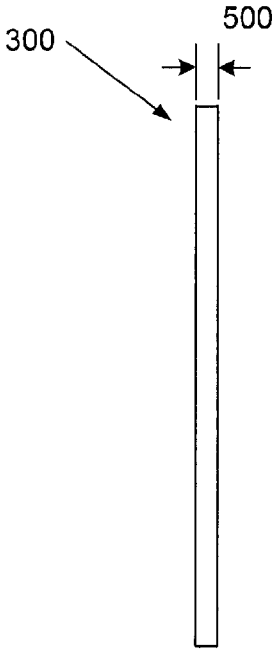
FIGS. 5B and 5C are, respectively, side and top plan views of the lid of FIG. 5A.
Figure 5C:
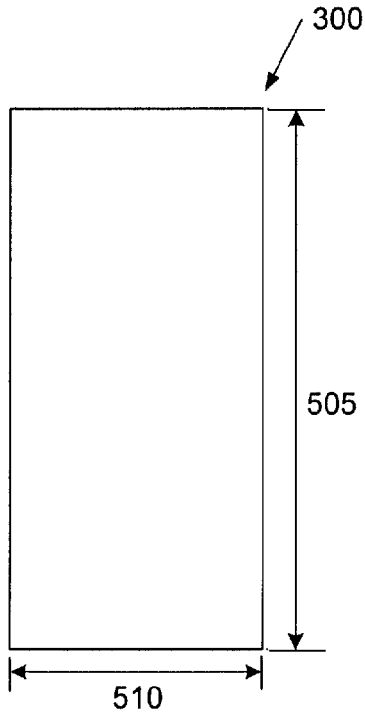

Referring also to FIGS. 4A-4E, the inlet and outlet fittings 310, 315 include a base 400 from which the port 312, 317 extends. The port 312, 317 defines a fluid channel 405 that extends to an opening 410 of the base 400. The base 400 also includes a lip 415 that is shaped to fit within openings 330, 335 formed in the base plate 305, as described in greater detail below. Referring also to FIGS. 5A-5C, the lid 300 has a generally flat, rectangular shape that is sized to mate with the base plate 305. In one implementation, the lid 300 has a thickness 500 of about 0.1 inch, a length 505 of about 3.2 inches, and a width 510 of about 1.5 inches.

Figure 6A:
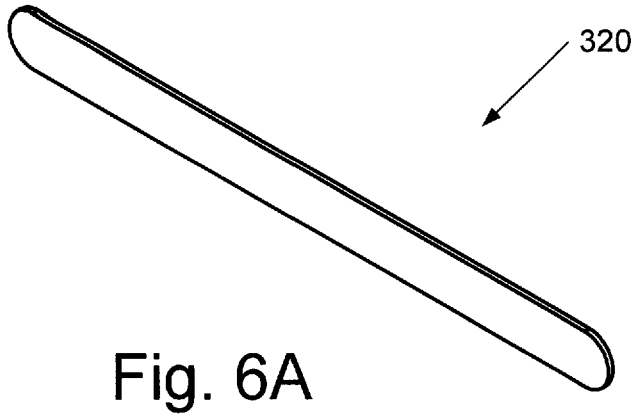
FIG. 6A is a perspective view of a flow regulator of the condenser of FIG. 3A.
Figure 6B:
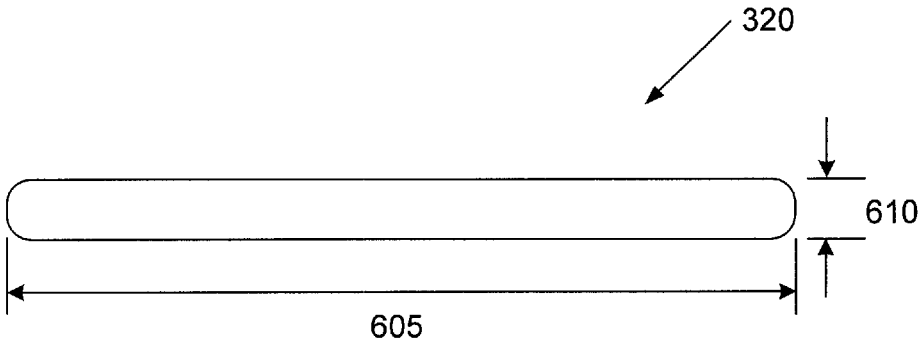
FIGS. 6B and 6C are, respectively, top and side plan views of the flow regulator of FIG. 6A.
Figure 6C:
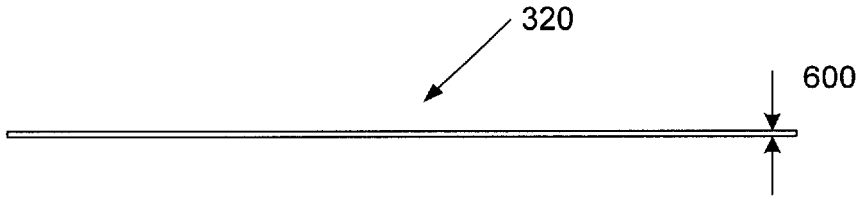
Figure 7A:
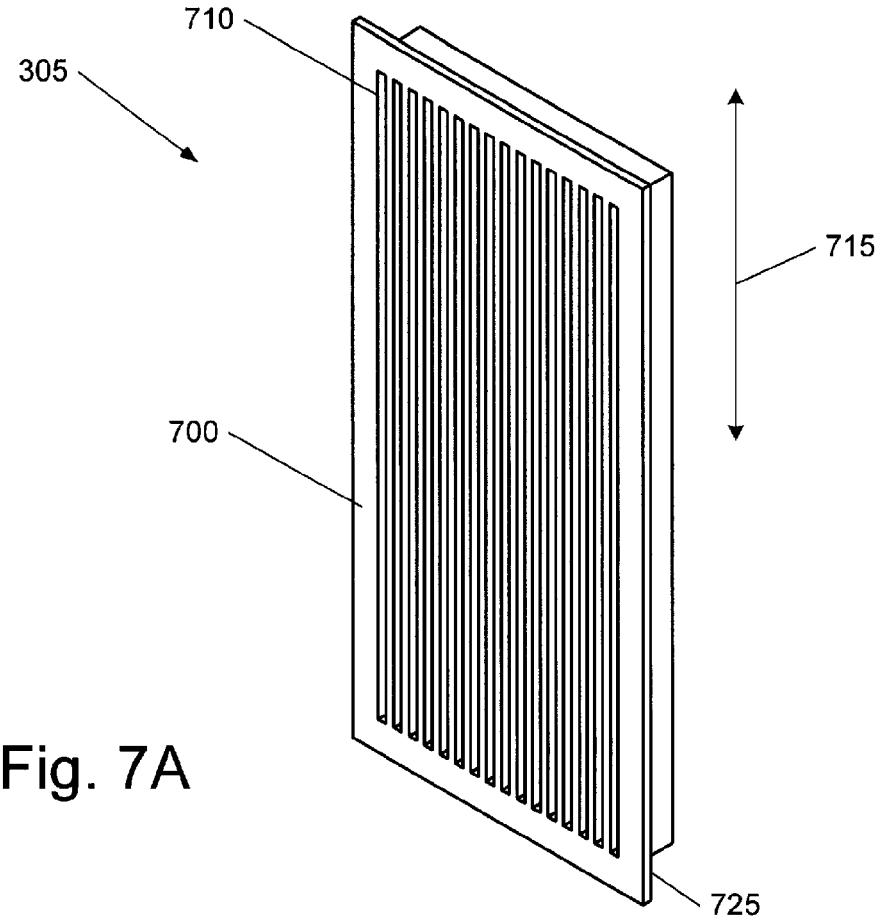
FIG. 7A is a perspective view of a base plate of the condenser of FIG. 3A.
Figure 7B:
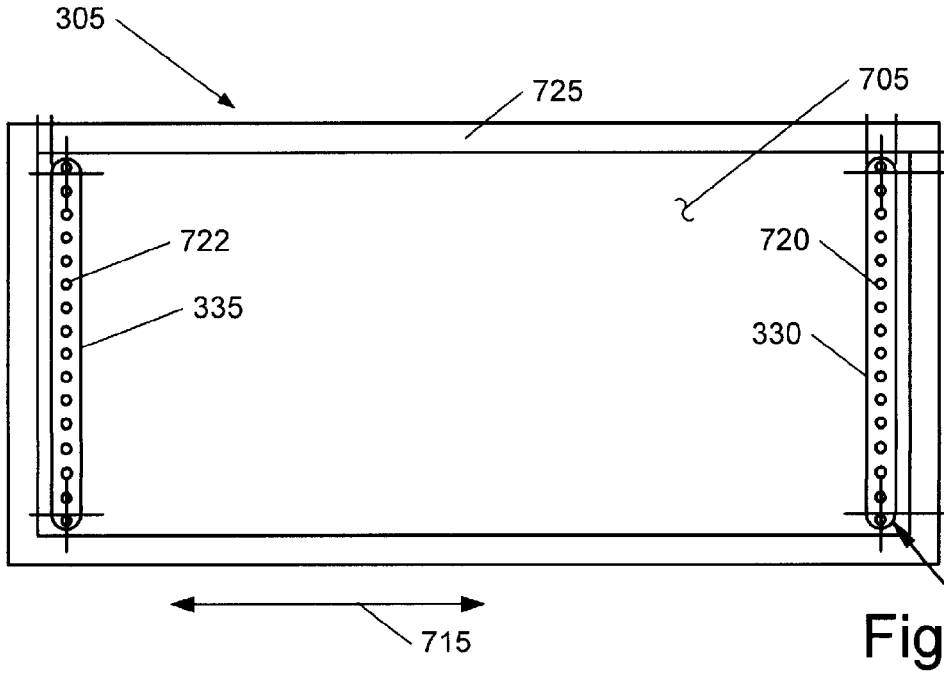

Referring also to FIGS. 6A-6C, the flow regulator 320 has a generally flat, thin, rectangular shape that has a size that permits the flow regulator 320 to be inserted into the opening 335 of the base plate 305. The flow regulator 320 is porous having pores sized to permit liquid to flow through the flow regulator 320 but to prevent vapor from passing through the flow regulator 320. In one implementation, the flow regulator 320 is a copper mesh having a thickness 600 of about 0.005 inch, a length 605 of about 1.2 inches, and a width 610 of about 0.1 inch.

Referring also to FIGS. 7A-7E, the base plate 305 includes a first side 700 that faces the lid 300 (FIG. 3A), and a second side 705. The second side 705 includes the openings 330, 335 and receives the flow regulator 320 and the inlet and outlet fittings 310, 315 (FIGS. 3A-3D), respectively, and the second side 705 serves as an outer surface of the condenser 115 (FIG. 1). The first side 700 includes fluid flow grooves 710 that extend along an axial direction 715 of the base plate 305 and fluidly couple to respective fluid holes 720 on the second side 705 that are defined within the openings 330, 335. The first side 700 also includes a flange 725 along a periphery of the first side 700.

In one implementation, the flow grooves 710 can have a width 750 of about 0.04 inch, a length 755 of about 3 inches, and a depth 760 of about 0.2 inch. The base plate 305 can have a length 765 of about 3.2 inches along the first side 700, a width 770 of about 1.5 inches, and a height 775 of about 0.25 inch.

During manufacture of the condenser 115, each of the lid 300, the base plate 305, and the fittings 310, 315 are formed by, for example, machining or molding. The flow regulator 320 is inserted into the opening 335 of the base plate 305 (as shown by arrow 350 in FIGS. 3C and 3D), and the fittings 310, 315 are press fit into their respective openings 330, 335 (as shown by respective arrows 360, 365 in FIGS. 3C and 3D). In this way, the flow regulator 320 is pressed against the holes 722 defined in the opening 335. The fittings 310, 315 are joined to the base plate 305 by sealing the fittings 310, 315 to the base plate 305 at the respective openings 330, 335 using a suitable sealing process like soldering, welding, or brazing. The lid 300 is joined to the base plate 305 at the contact region between the first side 700 of the base plate 305 and the lid 300

Figure 3A:
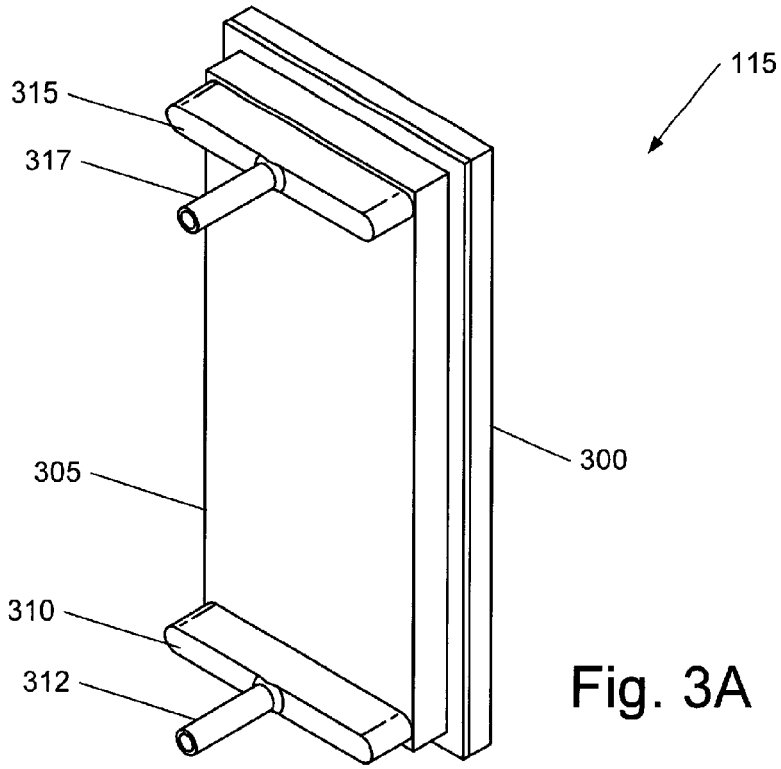
FIG. 3A is a perspective view of a condenser in the heat transfer system of FIG. 1.
Figure 3B:
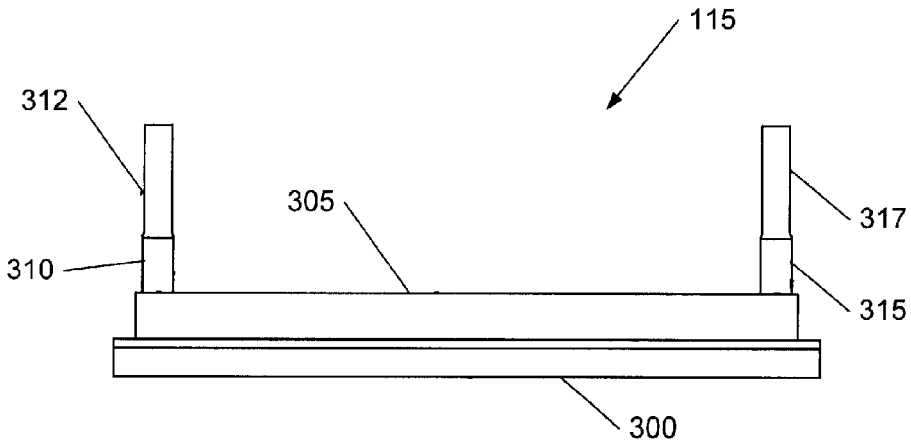
FIG. 3B is a side plan view of the condenser of FIG. 3A.
Figure 3C:
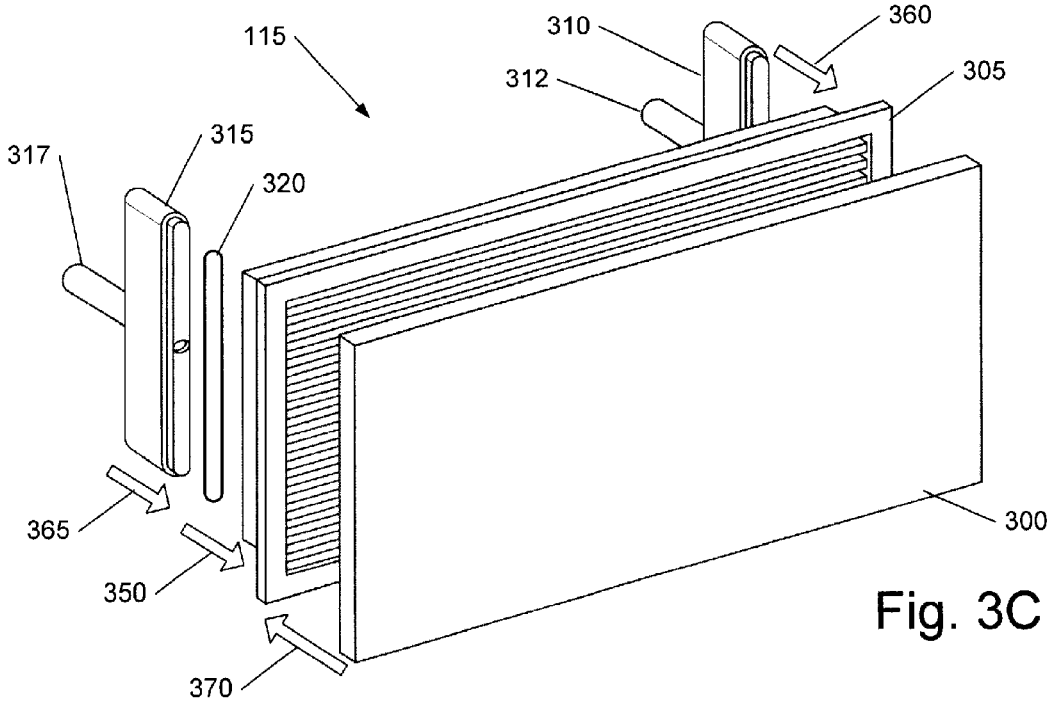
FIGS. 3C and 3D are exploded perspective views of the condenser of FIG. 3A.
Figure 3D:
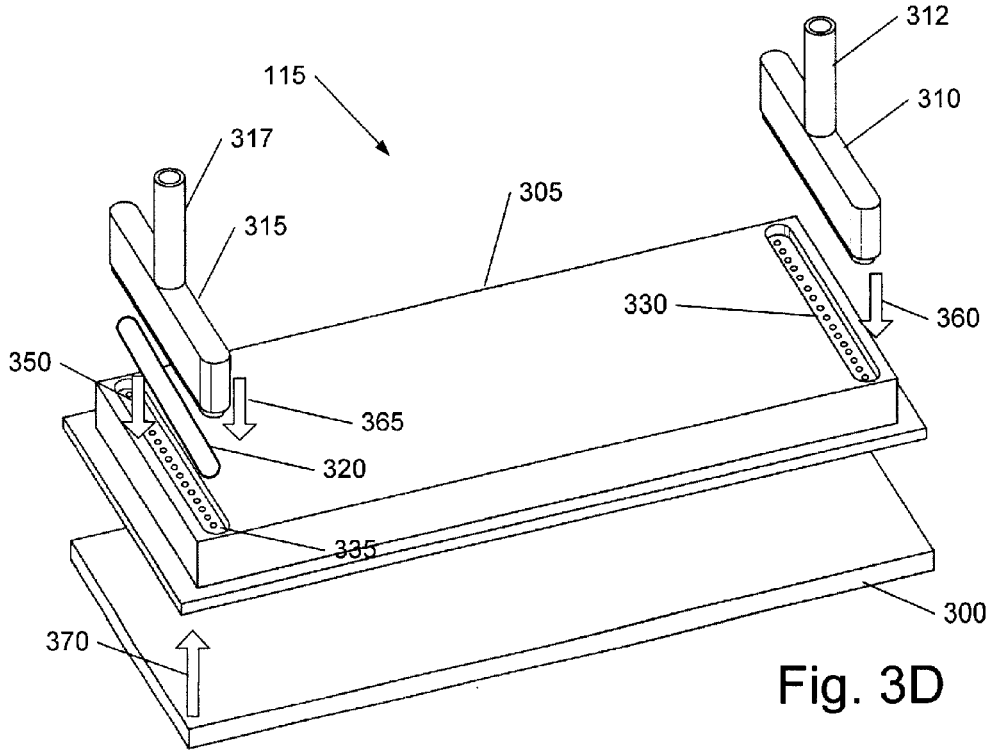
Figure 3F:
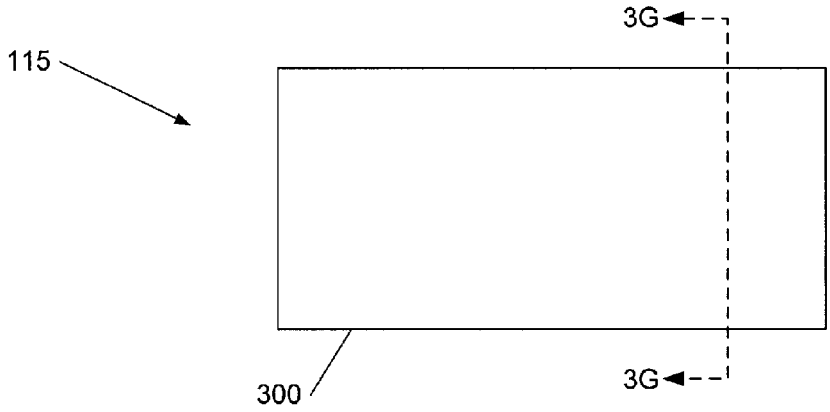
FIG. 3F is a bottom plan view of the condenser of FIG. 3A.
Figure 3E:
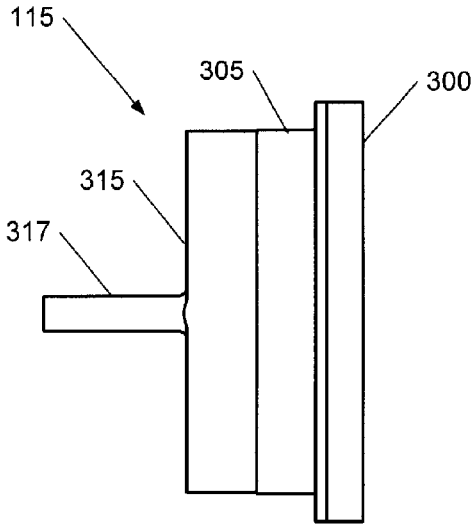
FIG. 3E is a side plan view of the condenser of FIG. 3A.
Figure 3G:
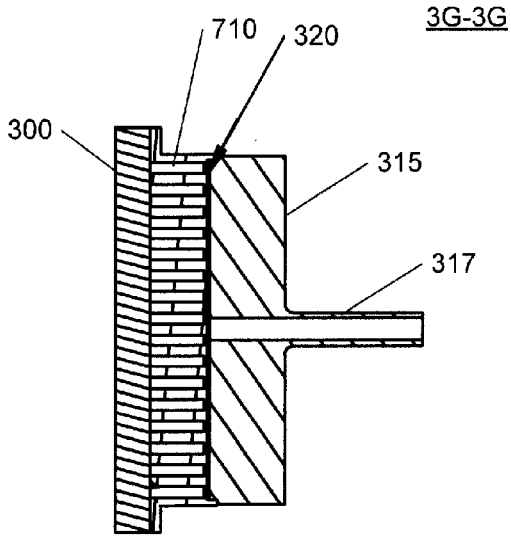
FIG. 3G is a cross-sectional view of the condenser of FIG. 3A taken along section line 3G-3G of FIG. 3F.
Figure 4A:
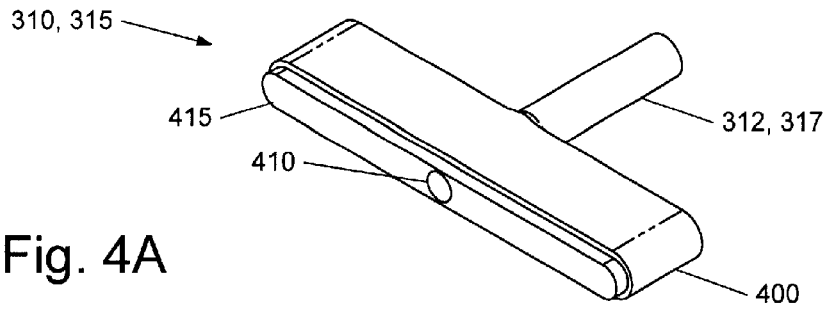
FIG. 4A is a perspective view of a fitting in the condenser of FIG. 3A.
Figure 4B:
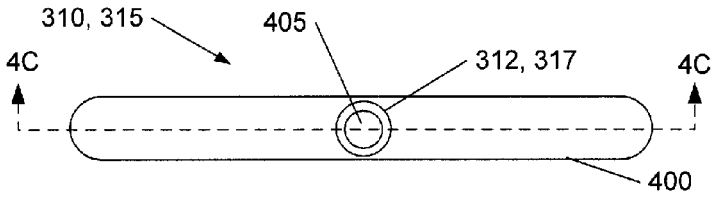
FIG. 4B is a bottom plan view of the fitting of FIG. 4A.
Figure 4C:
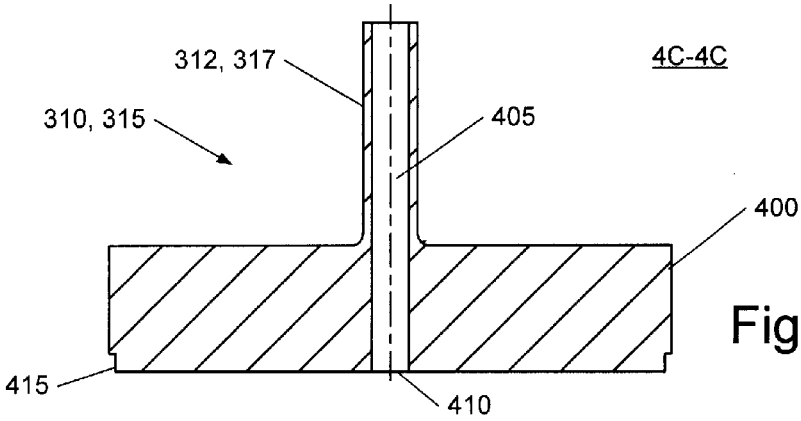
FIG. 4C is a cross-sectional view of the fitting of FIG. 4A taken along section line 4C-4C of FIG. 4B.
Figure 4D:
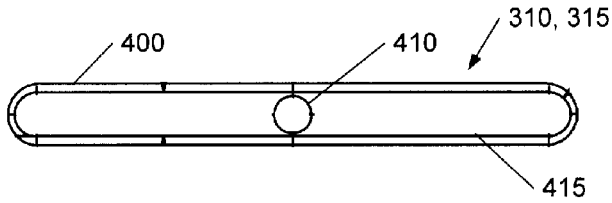
FIG. 4D is a top plan view of the fitting of FIG. 4A.
Figure 4E:
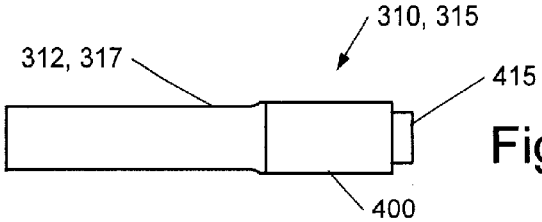
FIG. 4E is a side plan view of the fitting of FIG. 4A.

(as shown by arrow 370 in FIGS. 3C and 3D). For example, the lid 300 can be brazed to the base plate 305 along the flange 725 while heating in an oven.

In general, fluid flows into and through the condenser 115 at least in part due to capillary pressure built up within the primary evaporators 110, 111, 112 of the heat transfer system 100. In operation, fluid flows from the vapor line 125, into and through the inlet port 312 of the inlet fitting 310, through the opening 330 of the base plate 305, where the fluid is distributed across the opening 330, through the holes 720 defined within the opening 330, and into the flow grooves 710. Fluid flows along the axial direction 715 toward the holes 722 defined within the opening 335. Fluid that exits the holes 722 contacts the flow regulator 320, which is in intimate contact with the holes 722. Capillary pressure builds up at the flow regulator 320 because of its engagement with the holes 722 and its porous structure. Any vapor bubbles within the fluid that contacts the flow regulator 320 is prevented from flowing into the flow regulator 320 due to the capillary pressure. Thus, vapor bubbles within the fluid remain in the holes 722 and the flow grooves 710, and because of this, vapor bubbles that otherwise would have exited the condenser 115 are given more time to condense within the condenser 115. Moreover, fluid that flows through and out of the flow regulator 320 has fewer vapor bubbles. Fluid that exits the flow regulator 320 enters the opening 410 of the base 400, flows through the fluid channel 405 of the base 400 (FIGS. 4A-4E) of the outlet fitting 315, through the outlet port 312, and into the liquid line 120 of the heat transfer system 100.

Referring to FIGS. 8A-8D, each of the primary evaporators 110, 111, 112 includes an outer enclosure 800 generally extending along an axial direction 820, a liquid inlet 805 coupled to and extending through the outer enclosure 800, a vapor outlet 810 coupled to and extending from the outer enclosure 800, and a wick 815 within the outer enclosure 800. Each of the primary evaporators 110, 111, 112 also includes a fluid outlet 825 coupled to and extending from the outer enclosure 800. As shown, the liquid inlet 805, the fluid outlet 825, and the vapor outlet 810 are shown as straight tubes extending out of the outer enclosure 800. Each of the tubes for the liquid inlet 805, the fluid outlet 825, and the vapor outlet 810 can be made of any suitable material, such as, for example, copper.

The liquid inlet 805 of the primary evaporator 110 is fluidly coupled to the liquid line 120, and the fluid outlet 825 of the primary evaporator 110 is fluidly coupled to the coupling line 130. The liquid inlet 805 of the primary evaporator 111 is fluidly coupled to the coupling line 130, and the fluid outlet 825 of the primary evaporator 111 is fluidly coupled to the coupling line 131. The liquid inlet 805 of the primary evaporator 112 is fluidly coupled to the coupling line 131, and the fluid outlet 825 of the primary evaporator 112 is fluidly coupled to the sweepage line 150. Moreover, each of the vapor outlets 810 of the primary evaporators 110, 111, 112 is fluidly coupled to the vapor line 125.

Referring also to FIGS. 9A-9E, the outer enclosure 800 is formed with an opening 900 that receives the wick 815, a side 905 that includes a surface 910 that makes thermal contact with the heat source that is to be cooled. In this example, the surface 910 of the side 905 is flat and rectangular to mate with a flat device to be cooled, such as, for example, a central processing unit (not shown). The outer enclosure 800 can be any thermally conductive material, such as, for example, a metal such as copper. The outer enclosure 800 also includes a flange 915 at one end of the opening 900. The flange 915 is sized to mate with and join to the vapor outlet 810. The outer enclosure 800 also includes a flange 920 at another end of the opening 900 to facilitate attachment of the outer enclosure 800 to devices at the liquid side of the evaporator 110, 111, 112, as further discussed below. The outer enclosure 800 can be made of any material suitable for reducing or minimizing heat conduction, such as, for example, MONEL®, stainless steel, ceramic, or plastic.

Referring again to FIGS. 8A-8D, each of the primary evaporators 110, 111, 112 can include a porous structure 830 adjacent the wick 815 and fluidly coupled to the liquid inlet 805 and the fluid outlet 825. In general, the porous structure 830 thermally isolates the wick 815 from the liquid inlet 805 and the fluid outlet 825.

Figure 10A:
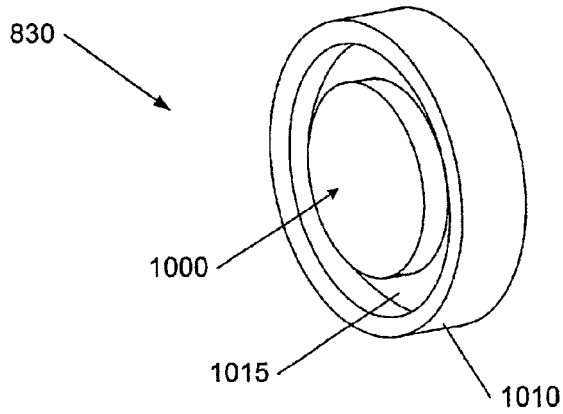
FIG. 10A is a perspective view of a porous structure of the evaporator of FIG. 8A.
Figure 10B:
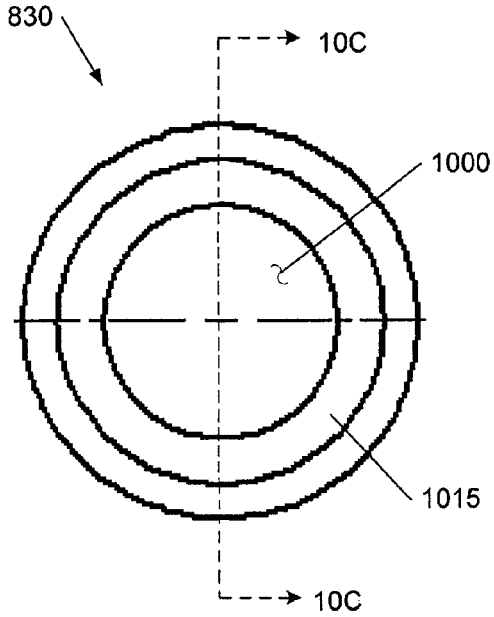
FIG. 10B is a front plan view of the porous structure of FIG. 10A.
Figure 10C:
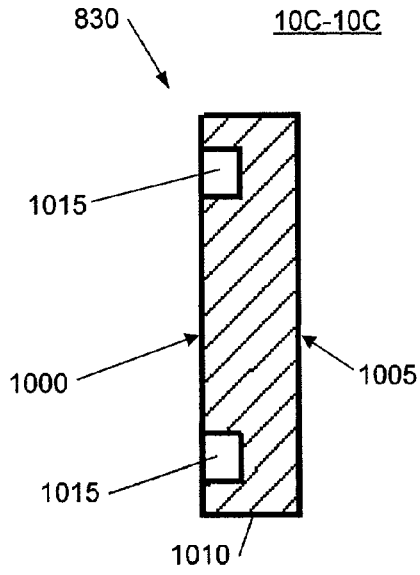
FIG. 10C is a cross-sectional view of the porous structure of FIG. 10A taken along section line 10C-10C of FIG. 10B.

Referring also to FIGS. 10A-10C, the porous structure 830 has a generally cylindrical or disk shape. The porous structure 830 includes a first side 1000 that faces the liquid inlet 805 and the fluid outlet 825, a second side 1005 that contacts the wick 815, and a cylindrical surface 1010 that contacts the outer enclosure 800 (or a separate end cap 835 coupled to the outer enclosure 800, as discussed below). The first side 1000 includes a circular channel 1015 that is in fluid communication with the liquid inlet 805 and the fluid outlet 825 when the secondary evaporator 145 is assembled. The porous structure 830 has a thermal conductivity that is less than a thermal conductivity of the wick 815 to reduce back conduction through the wick 815. The porous structure 830 has pores that are sized to permit liquid to pass through the porous structure 830 but block vapor flow through the porous structure 830. Moreover, a gap between the porous structure 830 and the wick 815 is smaller than an effective pore size of the pores within the wick 815 to effectively seal the wick 815. The porous structure 830 can be made of any material having these properties. For example, if the working fluid in the heat transfer system 100 is water, then the porous structure 830 can be made of porous TEFLON®.

Referring again to FIGS. 8A-8D, each of the primary evaporators 110, 111, 112 can include an end cap 835 bonded to the outer enclosure 800 and contacting the wick 815 and/or the porous structure 830. The liquid inlet 805 and the fluid outlet 825 couple to and extend through the end cap 835.

Figure 11A:
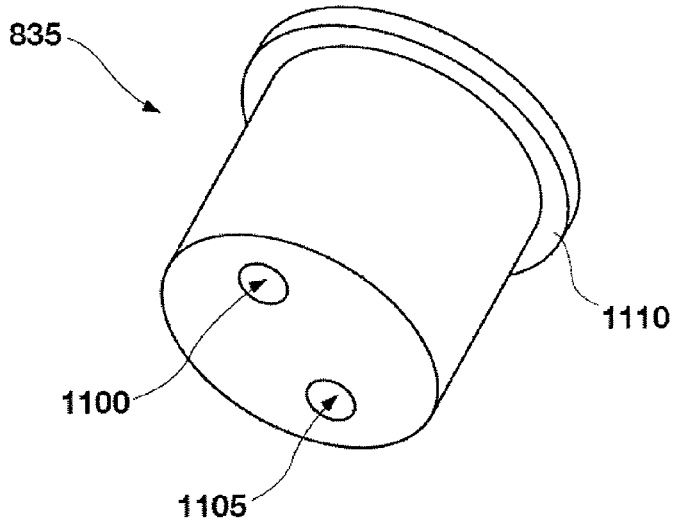
FIG. 11A is a perspective view of an end cap of the evaporator of FIG. 8A.
Figure 11B:
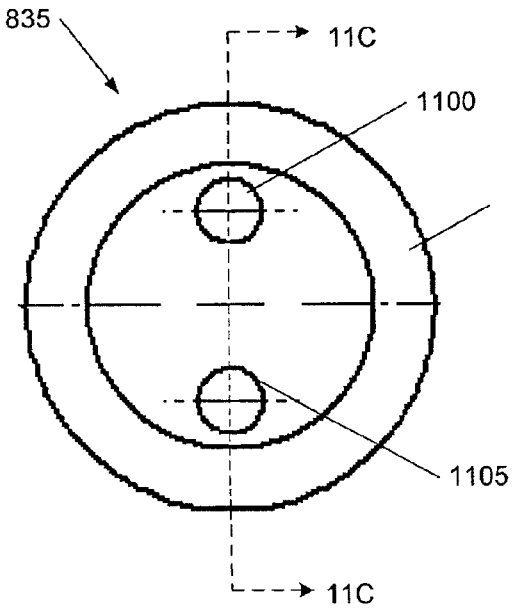
FIG. 11B is a front plan view of the end cap of FIG. 11A.
Figure 11C:
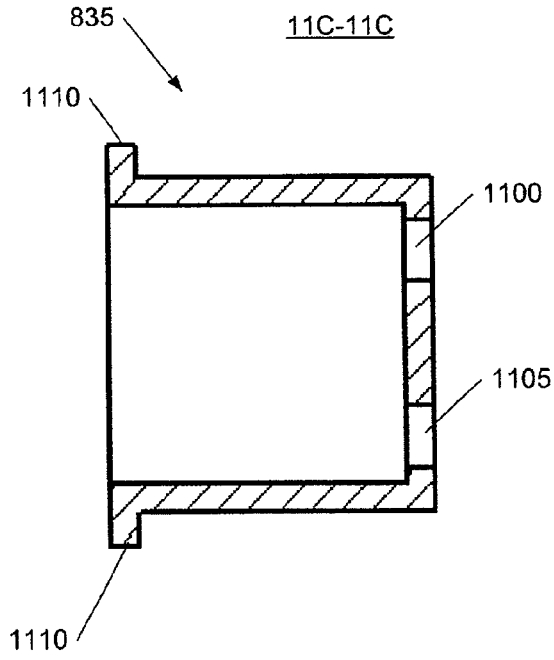
FIG. 11C is a cross-sectional view of the end cap of FIG. 11A taken along section line 11C-11C of FIG. 11B.
Figure 12B:
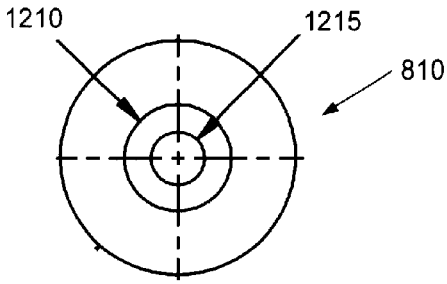
FIGS. 12B, 12C, and 12E are, respectively, top, side, and bottom plan views of the vapor outlet of FIG. 12A.
Figure 12A:
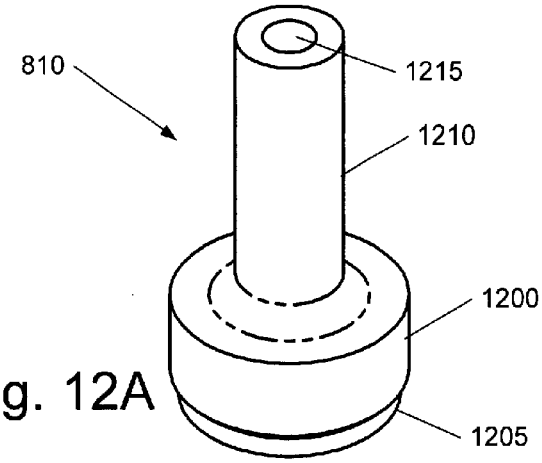
FIG. 12A is a perspective view of a vapor outlet of the evaporator of FIG. 8A.
Figure 12C:
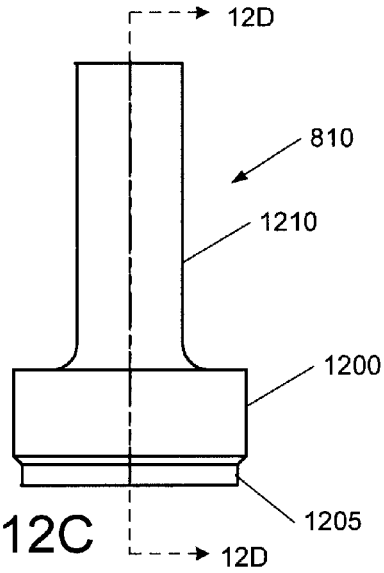
Figure 12D:
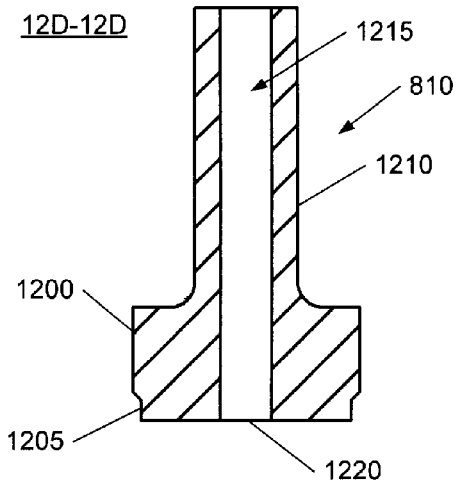
FIG. 12D is a cross-sectional view of the vapor outlet of FIG. 12A taken along section line 12D-12D of FIG. 12C.
Figure 12E:
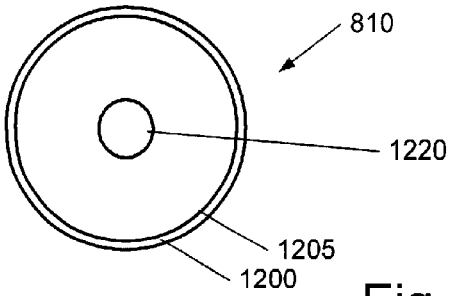
Figure 13A:
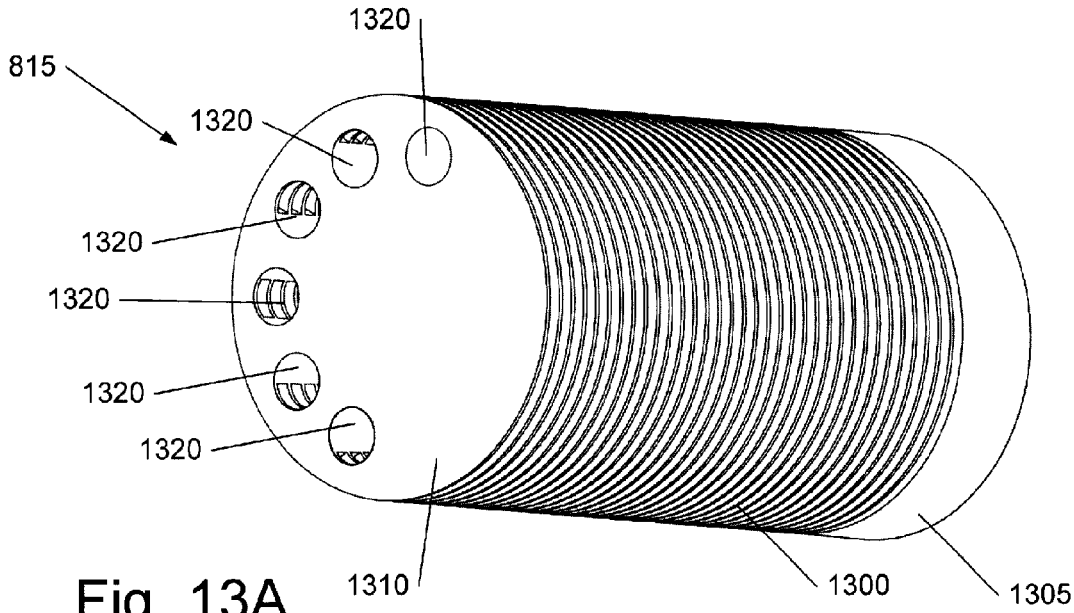
FIGS. 13A and 13B are perspective views of a wick of the evaporator of FIG. 8A.
Figure 13B:
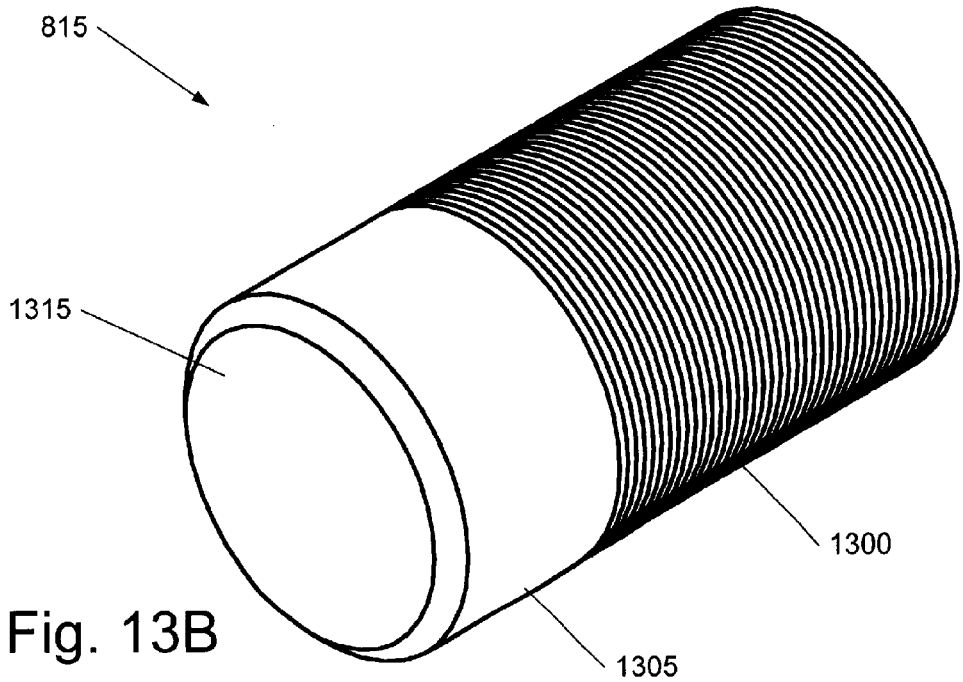
Figure 13C:
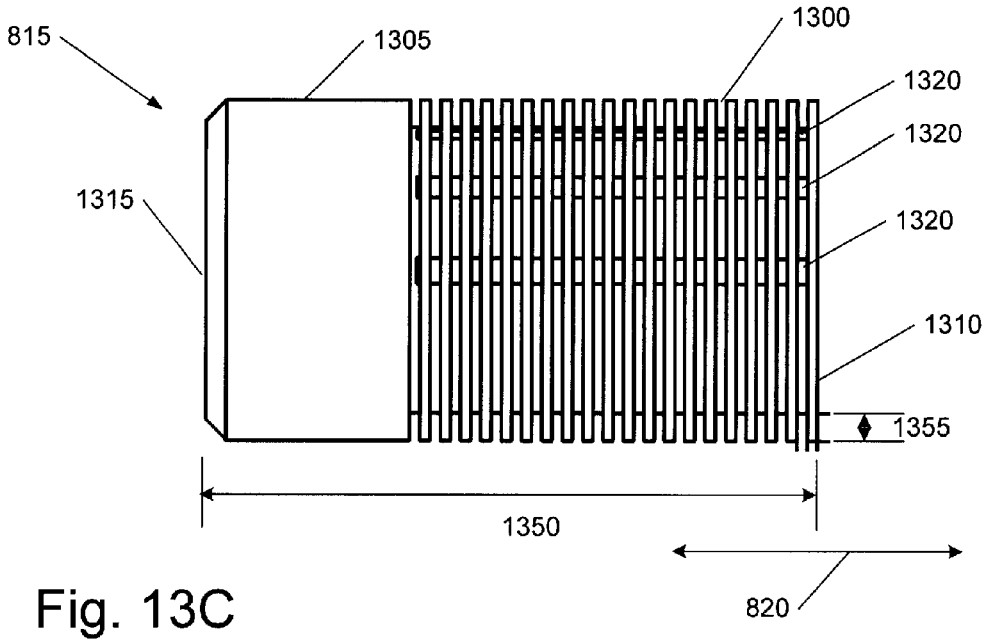
FIG. 13C is a side plan view of the wick of FIGS. 13A and 13B.
Figure 13D:
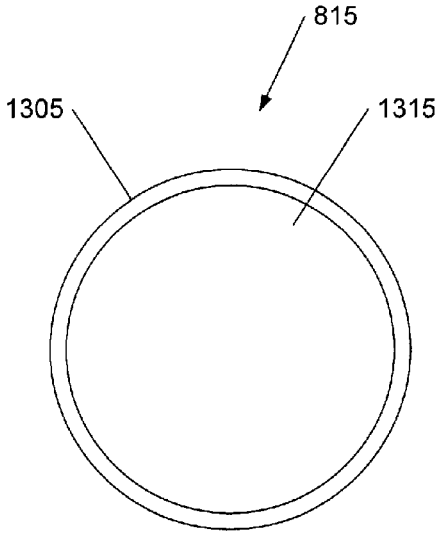
FIGS. 13D and 13E are, respectively, front and rear plan views of the wick of FIGS. 13A and 13B.
Figure 13E:
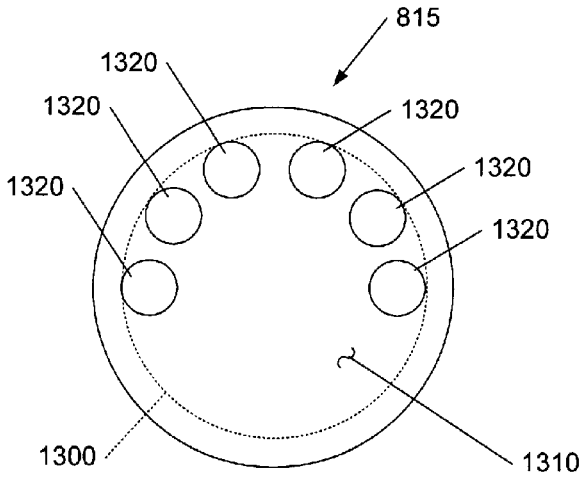
Figure 14A:
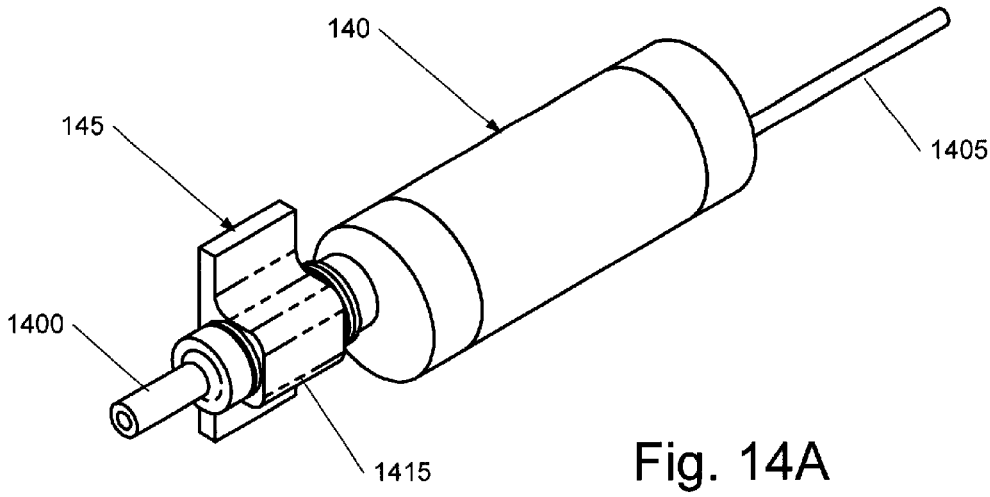
FIG. 14A is a perspective view of a secondary system including an evaporator and a reservoir of the heat transfer system of FIG. 1.
Figure 14B:
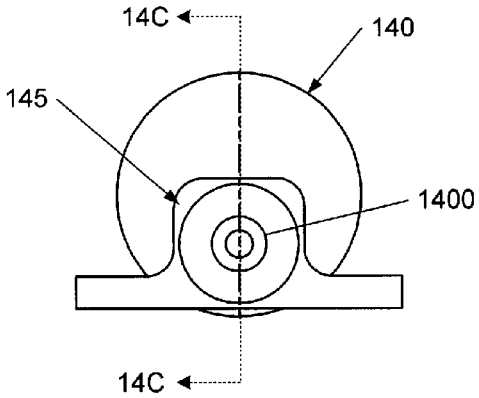
FIG. 14B is a front plan view of the secondary system including an evaporator and a reservoir of FIG. 14A.
Figure 14D:
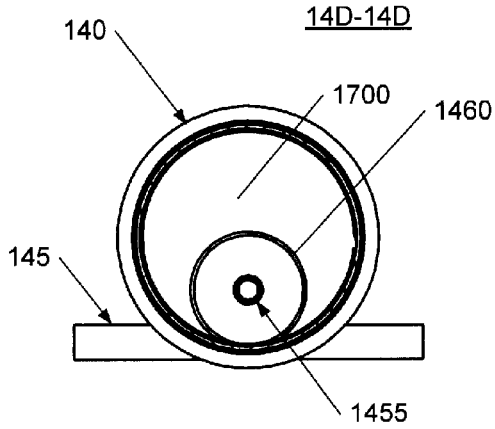
FIG. 14D is a cross-sectional view of the secondary system of FIG. 14A taken along section line 14D-14D of FIG. 14C.
Figure 14C:
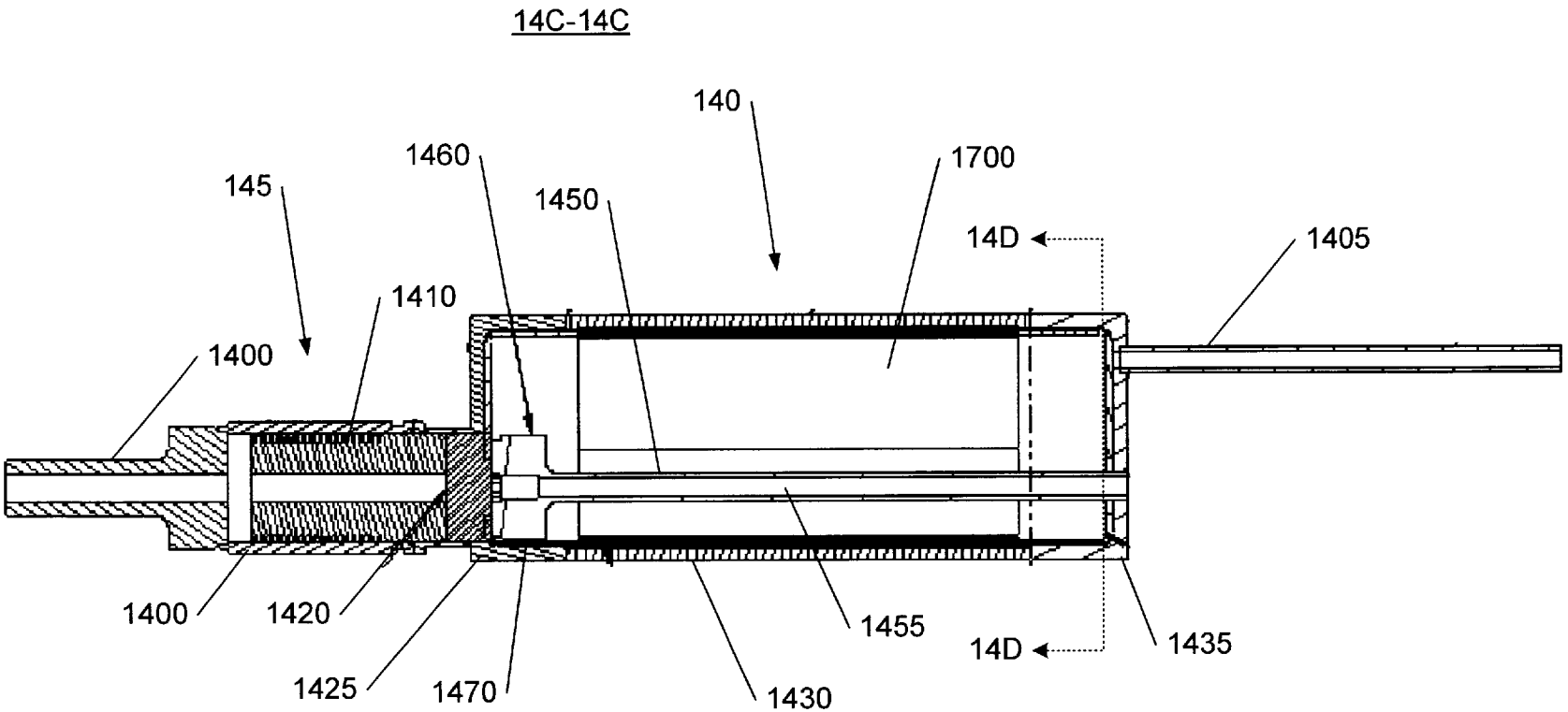
FIG. 14C is a cross-sectional view of the secondary system of FIG. 14A taken along line 14C-14C of FIG. 14B.

Referring also to FIGS. 11A-11C, the end cap 835 has a cylindrical shape having an inner diameter that is large enough to fit over the wick 815 and/or the porous structure 830 and to bond to the outer enclosure 800. The end cap 835 includes openings 1100, 1105 through which the liquid inlet 805 and the fluid outlet 825 respectively extend. The end cap 835 includes a flange 1110 that mates with the flange 920 of the outer enclosure 800. The end cap 835 has a thermal conductivity that is less than a thermal conductivity of the outer enclosure 800. The end cap 835 seals the wick 815 in that a gap between the end cap 835 and the wick 815 is smaller than an effective pore size of the wick 815. The end cap 835 can be joined to the outer enclosure 800 by welding the end cap 835 to the outer enclosure 800 at the flanges 920, 1110.

The end cap 835 is made of a material having a thermal conductivity that is lower than that of the outer enclosure 800 to reduce back conduction between vapor inside the evaporator and the liquid inside the end cap 835. In one implementation, the end cap 835 is made of MONEL®. The end cap 835 encloses the liquid within the porous structure 830 and thermally separates the liquid from the vapor in the evaporator wick 815 by having low conductance itself and also by pressing the low-conductivity porous structure 830 against the outer enclosure 800 and the wick 815.

Referring also to FIGS. 12A-12E, the vapor outlet 810 includes a base fitting 1200 having a lip 1205 that mates with the flange 915 of the outer enclosure 800. The vapor outlet 810 includes an outlet port 1210 extending from the fitting 1200 and defining a vapor channel 1215 that extends to an opening 1220 of the base fitting 1200. The vapor outlet 810 can be made of any suitable material, including, for example, copper. The vapor outlet 810 can be formed by machining or molding, depending on the material used.

During manufacture, the liquid inlet 805 and the fluid outlet 825 can be made with tubes that are joined by, for example, welding, to the end cap 835. Next, the wick 815 is inserted into the outer enclosure 800 and the porous structure 830 is inserted into the end cap 835. The vapor outlet 810 is attached to the outer enclosure 800 by first mating the flange 915 with the lip 1205, and the end cap 835 is attached to the outer enclosure 800 by first mating the flange 920 with the flange 1110. The relative sizes of the end cap 835 and the porous structure 830 can be such that the porous structure 830 is compressed when the end cap 835 is attached to the outer enclosure 800. Next, a seam between the flange 920 and the flange 1110 can be sealed by, for example, welding. A seam between the flange 915 and the lip 1205 can be sealed by, for example, welding, brazing, or soldering.

Referring to FIGS. 13A-13E, the wick 815 is designed with a generally cylindrical shape that extends along the axial direction 820. The wick 815 includes at least one circumferential groove 1300 around an outer surface 1305 circumferentially along a direction that is non-parallel with the axial direction 820. In one implementation, the circumferential groove 1300 can extend in a spiral manner as one continuous loop for fluid around the outer surface 1305. In another implementation, the wick 815 includes a plurality of circumferential grooves 1300 separated from each other and wrapping around the outer surface 1305 to make up individual loops for fluid. When assembled, the circumferential groove 1300 contacts an inner surface of the outer enclosure 800. The wick 815 includes a first surface 1310 that faces the vapor outlet 810 when the secondary evaporator 145 is assembled and a second surface 1315 that contacts the porous structure 830 when the evaporator is assembled. The wick 815 includes axial vapor channels 1320 formed within a body of the wick 815 to extend from the first surface 1310 along an axial direction 820.

Each of the vapor channels 1320 is hydraulically linked to the circumferential groove 1300. The vapor channels 1320 are arranged along an inner circumference of the wick 815 and are drilled as blind holes in that they do not extend all the way through to the second surface 1315. In contrast to prior cylindrical evaporators, in one implementation, the primary evaporators 110, 111, 112 do not include a central hole or opening for central fluid flow and, instead, the primary evaporators 110, 111, 112 include one or more vapor channels 1320 that intersect the circumferential groove 1300 and are formed along an inner circumference of the wick 815.

Outer surface 1305 of the wick 815 has a structure that includes a protruding portion and a recessed portion, and the plurality of circumferential grooves 1300 is formed in a space defined between the protruding portions within the recessed portion.

Figure 8A:
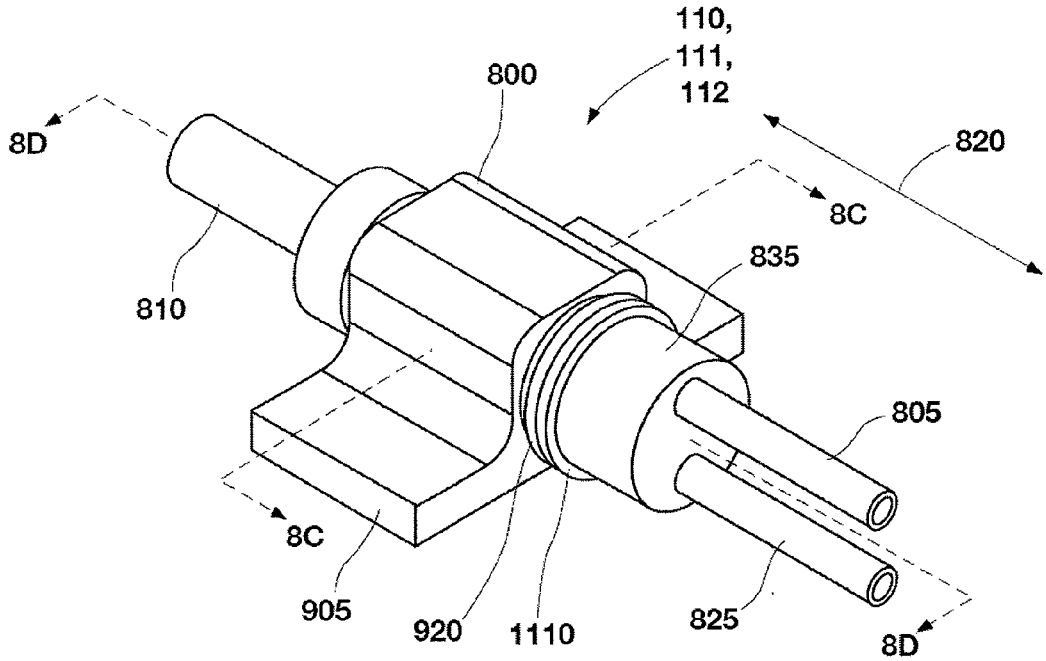
FIG. 8A is a perspective view of an evaporator in the heat transfer system of FIG. 1.
Figure 8B:
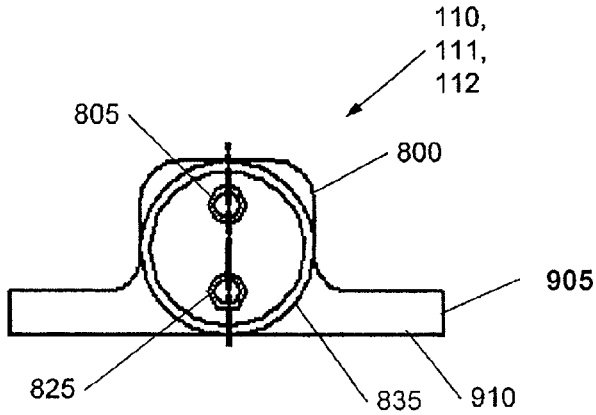
FIG. 8B is a side plan view of the evaporator of FIG. 8A.
Figure 8C:
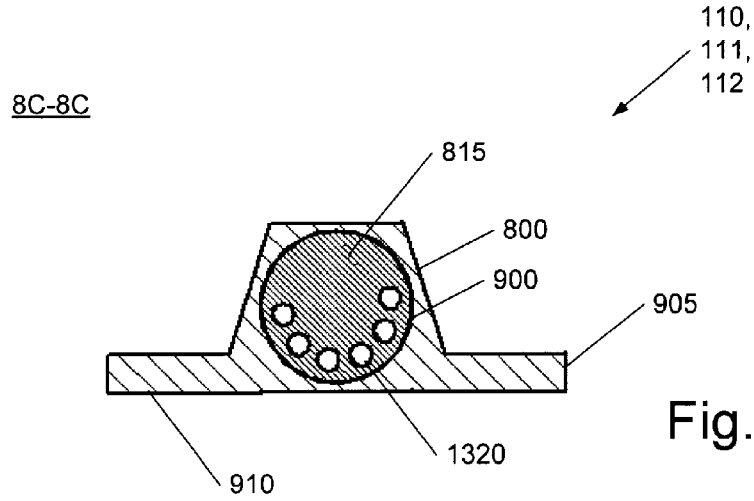
FIG. 8C is a cross-sectional view of the evaporator of FIG. 8A taken along section line 8C-8C.
Figure 8D:
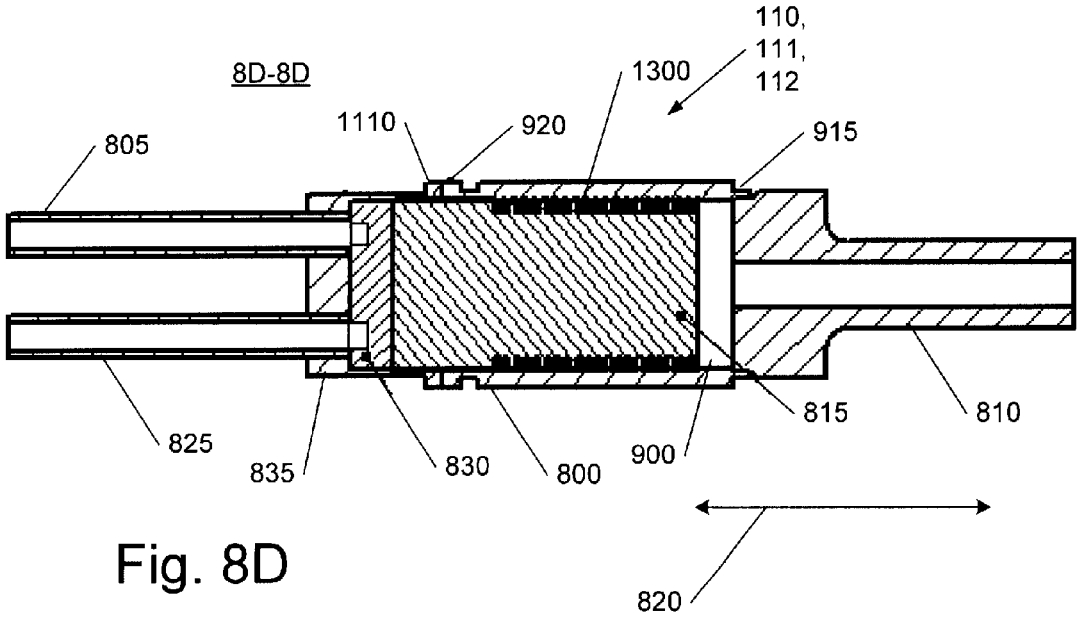
FIG. 8D is a cross-sectional view of the evaporator of FIG. 8A taken along section line 8D-8D.
Figure 9A:
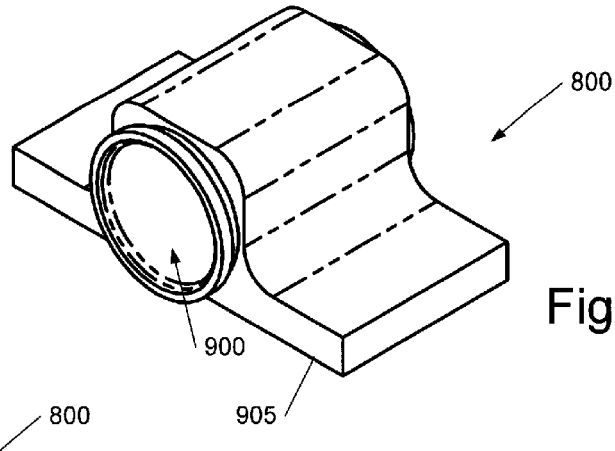
FIG. 9A is a perspective view of an outer enclosure of the evaporator of FIG. 8A.
Figure 9B:
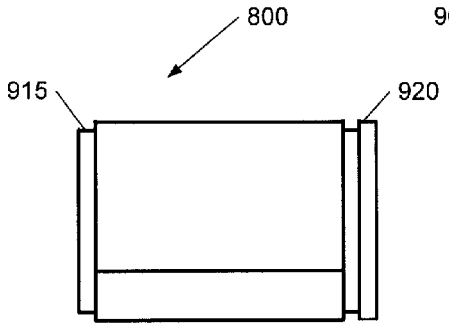
FIGS. 9B, 9C, and 9D are, respectively, side, front, and rear plan views of the outer enclosure of FIG. 9A.
Figure 9C:
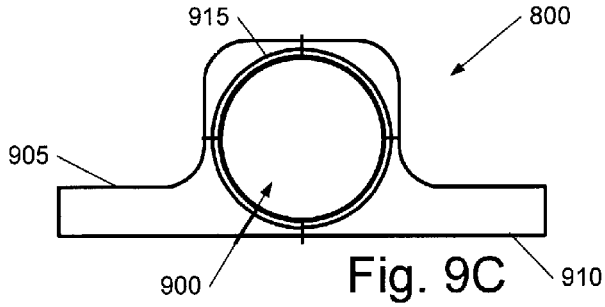
Figure 9E:
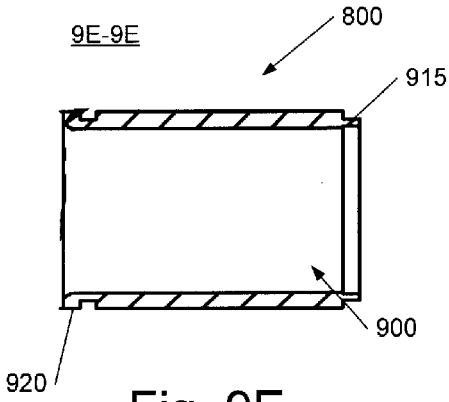
FIG. 9E is a cross-sectional view of the outer enclosure of FIG. 9A taken along section line 9E-9E of FIG. 9D.
Figure 9D:
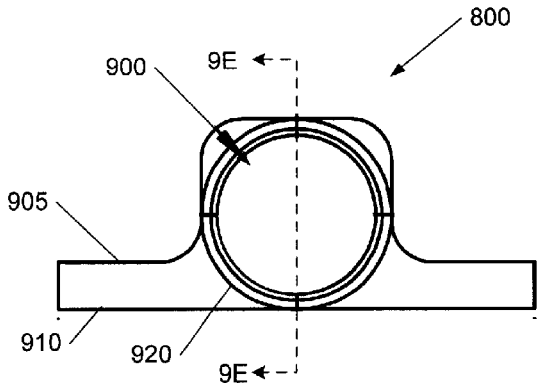

The wick 815 may be made of any porous material, such as, for example, porous titanium, porous copper, porous nickel, or porous stainless steel. Each of the vapor channels 1320 is in fluid communication with the vapor outlet 810, which couples to the vapor line 125. The vapor channels 1320 are arranged along a side of the wick 815 facing the surface 910, as shown in FIG. 8C. In one implementation, a length 1350 of the wick 815 is about 1 inch, a diameter of the wick 815 is about 0.5 inch, a depth 1355 of the circumferential groove 1300 is about 0.04 inch, and a diameter of the vapor channels 1320 is about 0.1 inch.

Groove 1300 can be produced on the outer surface 1305 by electro-discharge machining or by using a sharp tool on a lathe on which the wick 815 is placed. The axial vapor channels 1320 can be formed by drilling blind holes into a body of the wick 815. The end cap 835 can have an inner diameter that is the same as or slightly smaller than the outer diameter of the wick 815. In this way, the end cap 835 can be forced onto the end of the wick 815, or it can be heated to a suitable temperature to enable temporary expansion of its inner diameter to facilitate insertion of the wick 815 into the end cap 835.

In operation, fluid including liquid from the condenser 115 flows through the liquid channel 120, and enters the primary evaporator 110 (FIGS. 1 and 2) through its liquid inlet 805. Fluid passes through the channel 1015 of the porous structure 830, through the porous structure 830, and into the wick 815, where, due to the capillary pressure within the wick 815, travels toward the outer surface 1305. The liquid evaporates at the circumferential groove 1300 and forms vapor, which flows through the vapor channels 1320 along the axial direction 820 toward the vapor outlet 810 of the primary evaporator 110. Moreover, fluid overflow from the evaporator 110 exits the fluid outlet 825, enters the coupling line 130, and feeds the liquid inlet 805 of the primary evaporator 111, where the process is repeated. Fluid overflow from the primary evaporator 112 can include vapor and/or non-condensable gas and is swept from the primary evaporator 112 through the sweepage line 150 and into the reservoir 140 (FIGS. 1 and 2).

Referring to FIGS. 14A-14D, the secondary evaporator 145 is coupled directly to the reservoir 140 as shown. The secondary evaporator 145 includes a vapor outlet 1400 that is fluidly connected to the vapor line 125, and the reservoir 140 includes a fluid inlet 1405 that is fluidly connected to the sweepage line 150.

The secondary evaporator 145 is designed similarly to the primary evaporators 110, 111, 112 in many respects. For example, the secondary evaporator 145 includes a wick 1410 housed within an enclosure 1415. Additionally, like the wick 815 in the primary evaporators 110, 111, 112, as discussed above, the wick 1410 can include a circumferential groove on its outer surface and one or more axial vapor channels. The secondary evaporator 145 is shown as having a flat heat receiving surface, though other geometries for the heat receiving surface are suitable. The secondary evaporator 145, in combination with the reservoir 140, serves as a pump to sweep vapor bubbles from the primary evaporators 110, 111, 112 and to prime the primary evaporators 110, 111, 112 during start-up of the heat transfer system 100 (as discussed above). The secondary evaporator 145 may be heated to facilitate its operation as a pump.

The secondary evaporator 145 can include a porous structure 1420 that is pressed into a transition piece 1425 that bridges the reservoir 140 and the secondary evaporator 145. The transition piece 1425 joins to the enclosure 1415 of the secondary evaporator 145 and to a casing 1430 of the reservoir 140. The reservoir 140 also includes a second transition piece 1435 that links the reservoir 140 with the sweepage line 150. The transition pieces 1425, 1435 may be made of MONEL®.

Figure 15A:
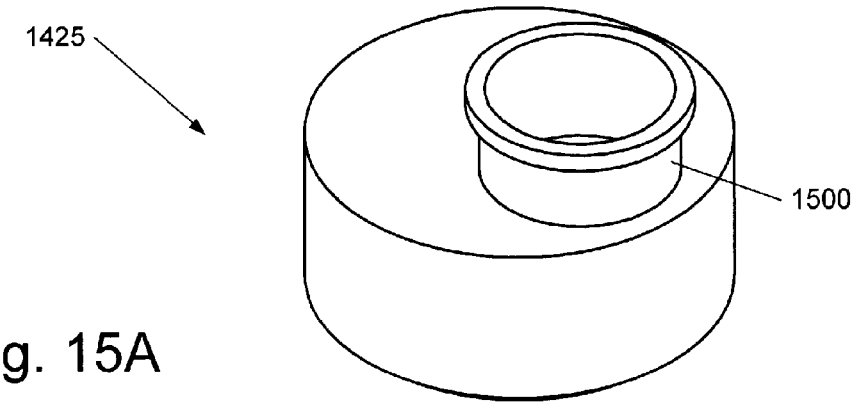
FIG. 15A is a perspective view of a transition piece of the secondary system of FIG. 14A.
Figure 15B:
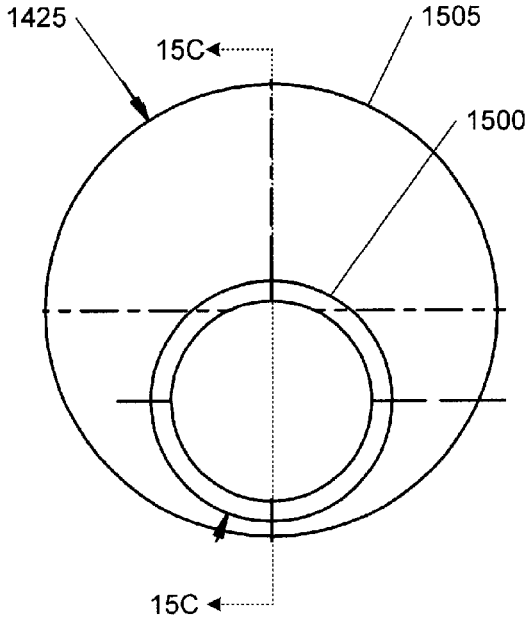
FIG. 15B is a front plan view of the transition piece of FIG. 15A.
Figure 15C:
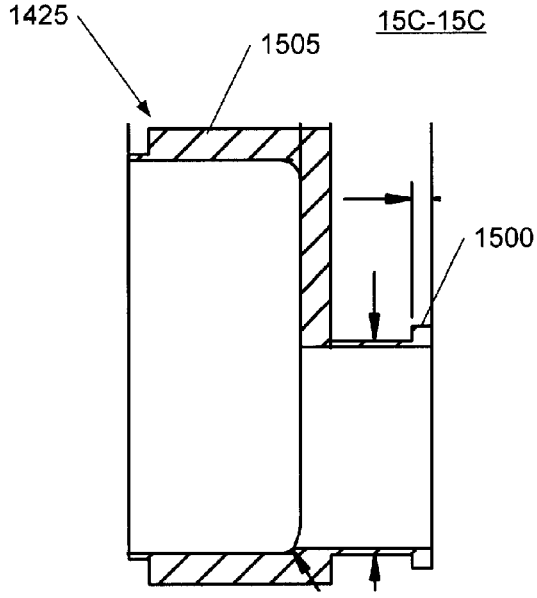
FIG. 15C is a cross-sectional view of the transition piece of FIG. 15A taken along section line 15C-15C of FIG. 15B.
Figure 16A:
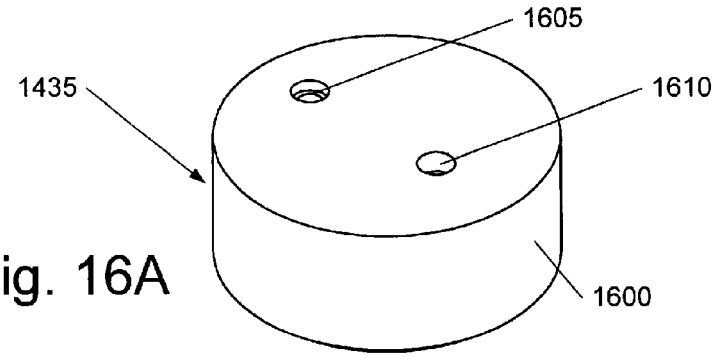
FIG. 16A is a perspective view of a transition piece of the secondary system of FIG. 14A.
Figure 16C:
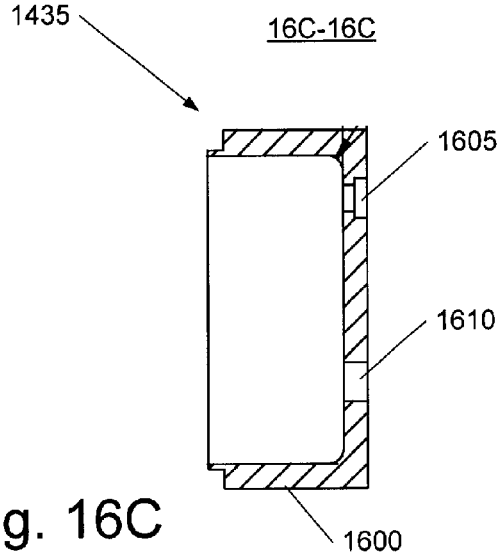
FIG. 16C is a cross-sectional view of the transition piece of FIG. 16A taken along section line 16C-16C of FIG. 16B.
Figure 16B:
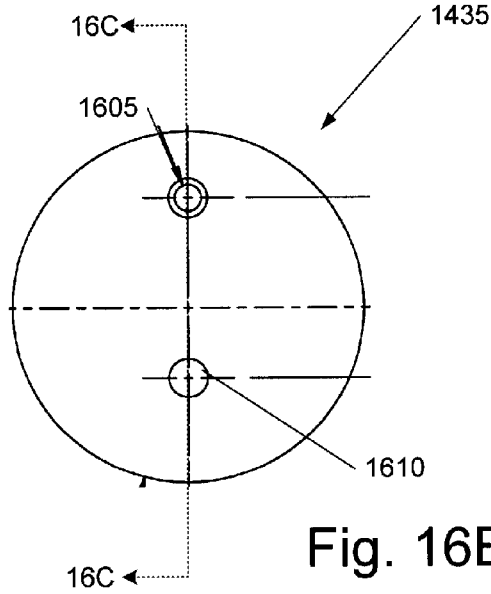
FIGS. 16B and 16D are, respectively, front and rear plan views of the transition piece of FIG. 16A.
Figure 16D:
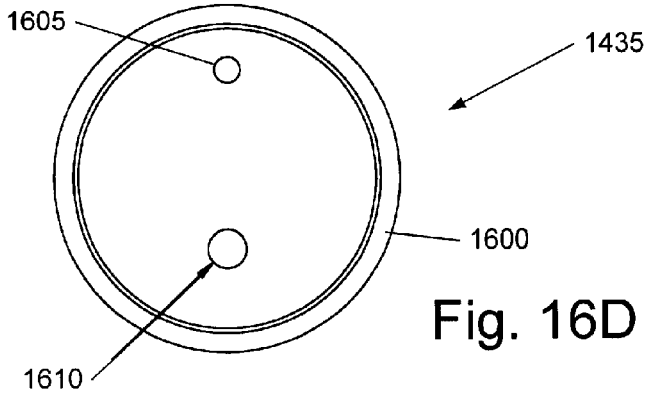

Referring also to FIGS. 15A-15C, the transition piece 1425 is generally cylindrical in shape and includes a flange 1500 that is joined to the enclosure 1415 of the secondary evaporator 145 and a flange 1505 that is joined to the casing 1430 of the reservoir 140. The porous structure 1420 fits within the flange 1500. Referring also to FIGS. 16A-16D, the transition piece 1435 is generally cylindrical in shape and includes a wall 1600 that joins with the casing 1430 of the reservoir 140. The transition piece 1435 includes an opening 1605 that is used to fill the reservoir 140 during manufacture, but prior to use. The transition piece 1435 includes an opening 1610 that couples to the sweepage line 150.

Figure 17A:
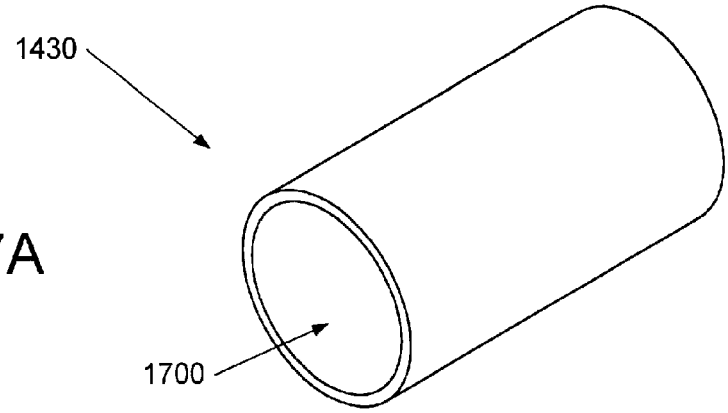
FIG. 17A is a perspective view of a reservoir casing of the secondary system of FIG. 14A.
Figure 17B:
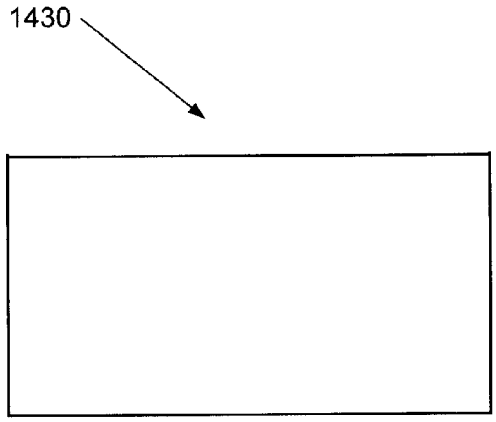
FIGS. 17B and 17C are, respectively, side and front plan views of the reservoir casing of FIG. 17A.
Figure 17C:
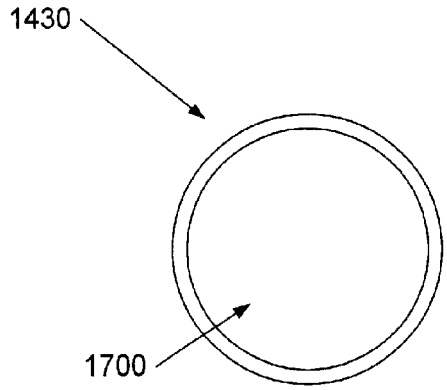

Referring also to FIGS. 17A-17C, the casing 1430 of the reservoir 140 is cylindrical in shape and includes a central opening that acts as an expansion volume 1700 to house the excess working fluid of the heat transfer system 100. The reservoir 140 may be cold-biased to the condenser 115 (FIGS. 1 and 2) with a thermal shunt (not shown).

Figure 18A:
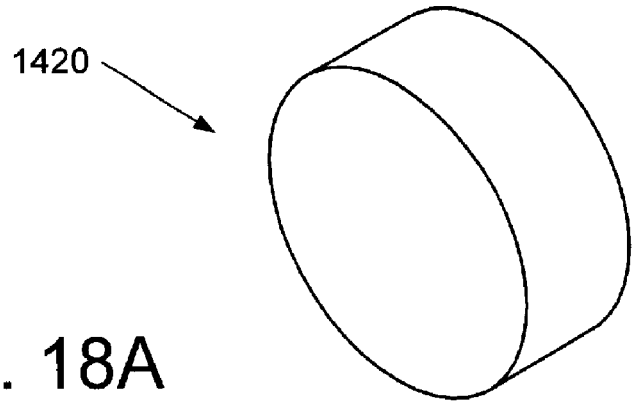
FIG. 18A is a perspective view of a porous structure of the secondary system of FIG. 14A.
Figure 18B:
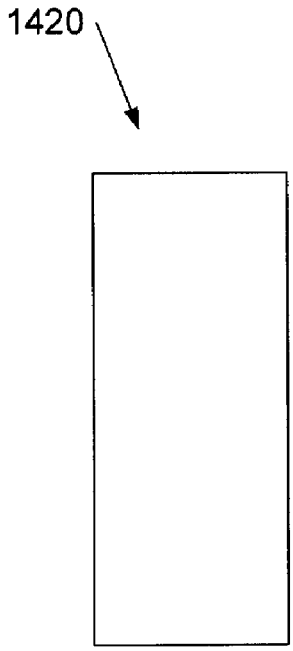
FIGS. 18B and 18C are, respectively, side and front plan views of the porous structure of FIG. 18A.
Figure 18C:
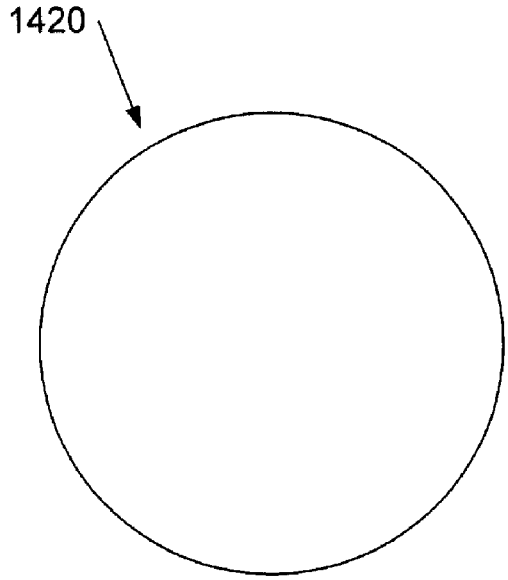

Referring also to FIGS. 18A-18C, the porous structure 1420 is generally cylindrical and is made of a low-conductivity material, that is, a material having a conductivity that is lower than the conductivity of the enclosure 1415. For example, the porous structure 1420 can be made of porous TEFLON™ or polytetrafluoroethylene (PTFE). The porous structure 1420 further reduces the back conduction into the reservoir 140.

Figure 19C:
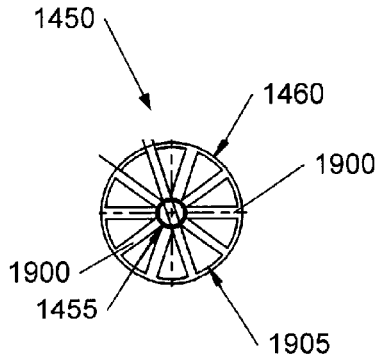
FIGS. 19B and 19C are, respectively, side and rear plan views of the reservoir tube of FIG. 19A.
Figure 19A:
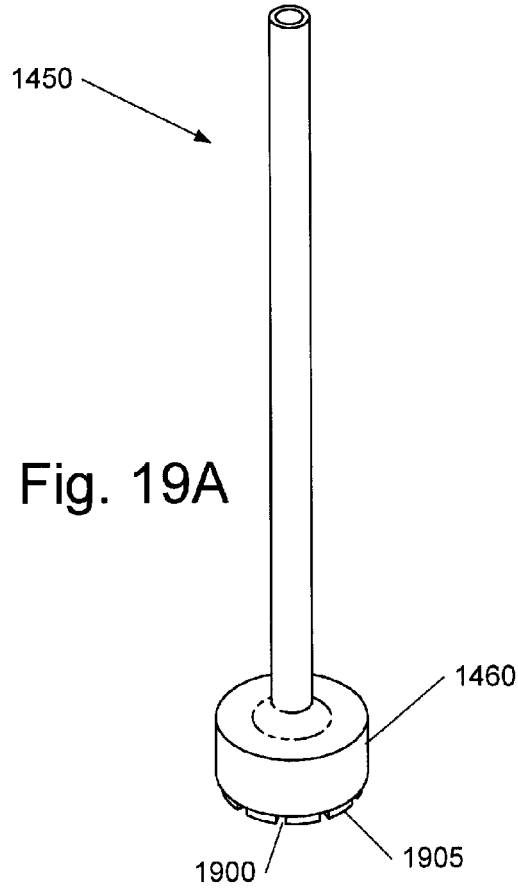
FIG. 19A is a perspective view of a reservoir tube of the secondary system of FIG. 14A.
Figure 19B:
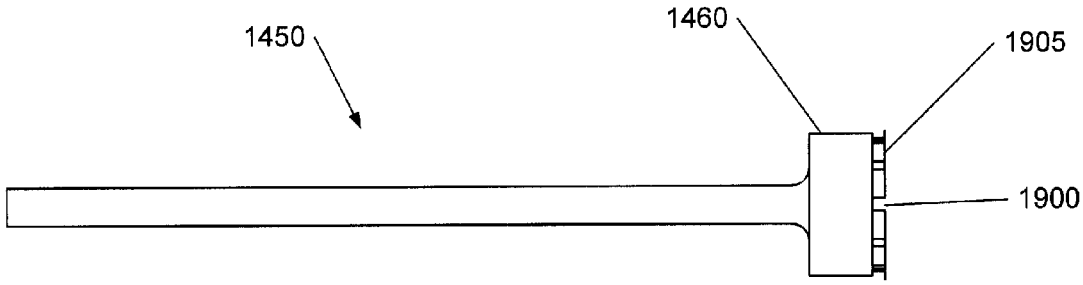

Referring again to FIG. 14C and also to FIGS. 19A-19C, the reservoir 140 includes a tube 1450 within the casing 1430 of the reservoir 140 that extends from the opening 1610 of second transition piece 1435 (FIG. 16C) through the reservoir 140 and to the porous structure 1420. The tube 1450 defines a channel 1455 that is fluidly coupled to the sweepage line 150 (FIG. 2) at the opening 1610 and to the porous structure 1420 (FIG. 18A) at a base structure 1460. The tube 1450 is not directly touching the wick 1410 of the secondary evaporator 145. Moreover, the porous structure 1420 thermally isolates the wick 1410 from the tube 1450 and from the opening 1610. The channel 1455 of the tube 1450 is in fluid communication with the expansion volume 1700 of the reservoir 140 at the base structure 1460.

In particular, the base structure 1460 includes channels 1900 defined between triangular protrusions 1905 at an outer surface of the base structure 1460. Fluid can flow from the opening 1610, through the channel 1455, and into the porous structure 1420 or fluid can flow from the opening 1610, through the channel 1455, through the channels 1900 between the protrusions 1905, and enter the expansion volume 1700 of the reservoir 1425. In this way, vapor that is unable to pass through the porous structure 1420 because of the capillary pressure developed at the structure 1420 can pass through the channels 1900 and into the expansion volume 1700, thus permitting any vapor within the fluid to exit the tube 1450 and enter the expansion volume 1700.

The reservoir 140 can also include a capillary-porous liner 1470 on its inner surface between the base structure 1460 and the casing 1430 and extending to and being in contact with the porous structure 1420. The capillary-porous liner 1470 can be made of a 100 mesh copper.

The reservoir 140 can also include an inner wall that is cooler than the working fluid within the reservoir 140. Any vapor that enters the expansion volume 1700 of the reservoir 140 is condensed on inner walls of the reservoir 140. That condensed liquid and any other liquid that saturates the capillary-porous liner 1470 is fed to the secondary evaporator 145 through the porous structure 1420 by way of capillary pressure regardless of the orientation of the reservoir 140 in a gravity field.

During manufacture, the tube 1450 is installed within the reservoir transition piece 1435 and then the transition piece 1435 is pressed against the casing 1430 of the reservoir 140. Then the transition piece 1435 is joined to the casing 1430 by, for example, welding.

Figure 20:
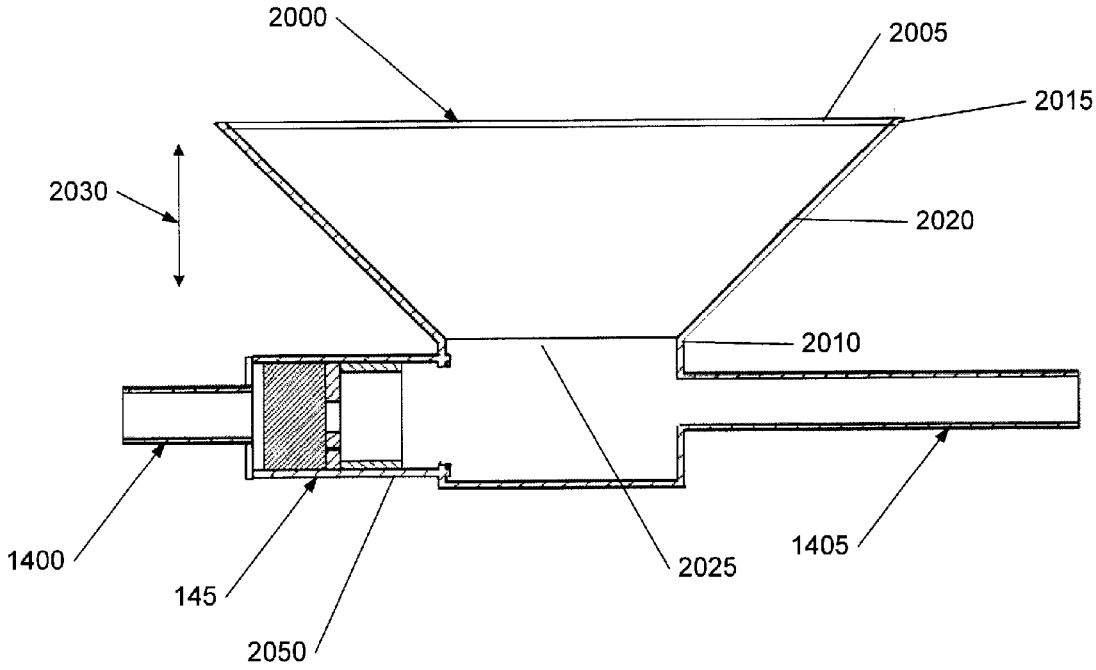
FIG. 20 is a side cross-sectional view of a secondary system including a reservoir and an evaporator in the heat transfer system of FIG. 1.

Referring to FIG. 20, in another implementation, the reservoir 140 can be shaped like a reservoir 2000, which is gravity-aided for use in terrestrial applications or in any applications that have a significant gravitational force. The reservoir 2000 has a casing 2005 including a first side 2010, a second side 2015, and a linking wall 2020 that extends between the first side 2010 and the second side 2015. The secondary evaporator 145 fluidly couples to the reservoir 2000 at an opening 2025 of the first side 2010 and the secondary evaporator 145 includes an enclosure 2050 that bonds with the casing 2005 to ensure a hermetically sealed space for fluid.

Figure 21A:
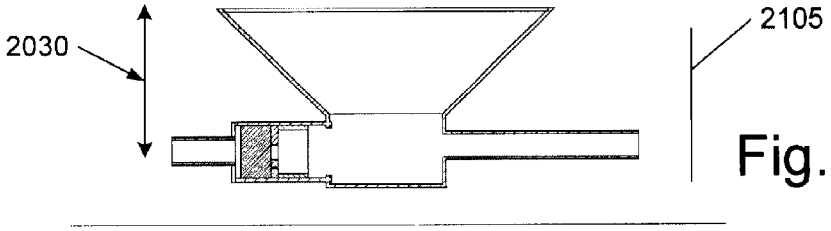
FIGS. 21A-21C are views of the secondary system of FIG. 20 at various tilt angles.
Figure 21B:
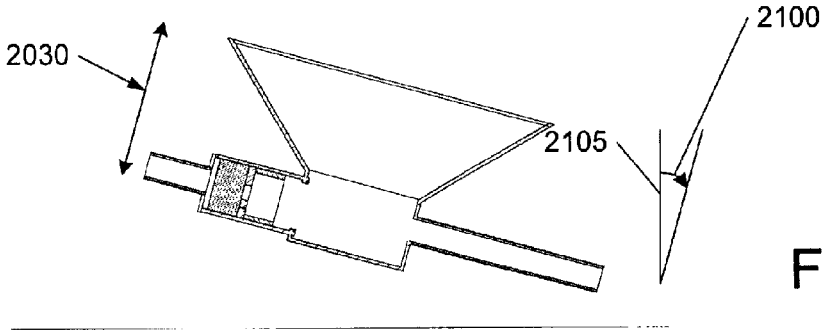
Figure 21C:
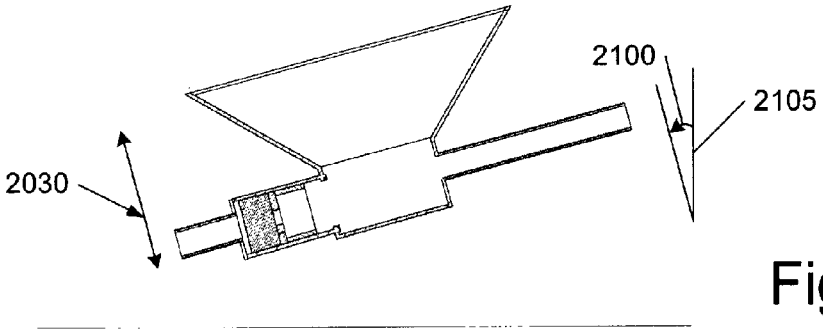

Referring also to FIGS. 21A-21C, a surface area of the first side 2010 as measured along a plane that is perpendicular to a linking direction 2030 is smaller than a surface area of the second side 2015 as measured along a plane that is perpendicular to the linking direction 2030. In this way, liquid is directed into the secondary evaporator 145 for a range of tilt angles 2100 as measured relative to the gravitational force 2105. The reservoir 2000 does not need to include a capillary-porous liner because the force of gravity can be enough to pull fluid through the reservoir 2000 and into the secondary evaporator 145. In one example, the reservoir 2000 can have a conical shape (as shown) in which the cross-sections of the first and second sides 2010, 2015 are circular. In other implementations, the cross-sections of the first and second sides 2010, 2015 can be oval, irregular, polygonal, square, or triangular. The reservoir 2000 can be pyramidal.

The reservoir 2000 can be made out of any suitable material that can retain the working fluid. For example, in one implementation, the reservoir 2000 is made of copper sheet, which is first cut into an appropriate shape and then formed or shaped into a cone with overlapping side ends to form the linking wall 2020. The overlapping side ends can then be welded or brazed together to form the linking wall 2020, and a lid is welded to the linking wall 2020 at the second side 2015. Next, the linking wall 2020 is bonded to the enclosure 2050 at the first side 2010 by, for example, welding the linking wall 2020 to the enclosure 2050.

Other implementations are within the scope of the following claims.

For example, while only three primary evaporators 110, 111, 112 are shown in the heat transfer system 100 above, the heat transfer system 100 can include any number of primary evaporators, depending on the configuration of and number of heat sources to be cooled.

As an alternative to the straight tube design described above in FIGS. 8A-8D, one or more of the liquid inlet 805, the fluid outlet 825, and the vapor outlet 810 may be bent in a low-profile design to extend along the surface of the outer enclosure 800.

In another implementation, the vapor channels 1320 may be formed all the way around the inner circumference, or fewer or more vapor channels 1320 than shown may be formed into the wick 815.

If needed, a thermal shunt made of a thermally conductive material such as copper may link the condenser 115 to the reservoir 140. The thermal shunt may be bonded at one end to a wall of the reservoir 140 (for example, to the casing 1430 of the reservoir 140) and at a second end to the base plate 305 of the condenser 115.

The primary evaporators 110, 111, 112 are shown as being connected in parallel with respect to vapor flow to the condenser 115 through the vapor line 125. In another implementation, the primary evaporators 110, 111, 112 are in series fluid communication with the vapor line 125 to the condenser 115. In this implementation, the vapor line 125 couples to only one of the evaporators 110, 111, or 112, and the next evaporator in the series outputs vapor to that one evaporator.

What is claimed is:

1. A heat transfer system comprising:

a first loop comprising:

a condenser including a vapor inlet and a liquid outlet;

a vapor line in fluid communication with the vapor inlet of the condenser;

a liquid line in fluid communication with the liquid outlet of the condenser; and primary evaporators fluidly coupled in series with the liquid line and in parallel with the vapor line; and a second loop comprising:

a reservoir;

a secondary evaporator having a vapor outlet fluidly coupled to the vapor line and a fluid inlet directly coupled to the reservoir; and a sweepage line directly coupled to the reservoir and at least one primary evaporator of the primary evaporators.

2. The heat transfer system of claim 1, wherein each of the primary evaporators includes a vapor outlet, a fluid inlet, and a fluid outlet.

3. The heat transfer system of claim 2, wherein the vapor line fluidly couples the vapor inlet of the condenser with the vapor outlet of each of the primary evaporators.

4. The heat transfer system of claim 2, wherein the liquid line fluidly couples the liquid outlet of the condenser with the fluid inlet of one of the primary evaporators.

5. The heat transfer system of claim 2, wherein the first loop and the second loop include a coupling line that fluidly couples a fluid outlet of one of the primary evaporators to a fluid inlet of another of the primary evaporators.

6. The heat transfer system of claim 1, wherein the first loop and the second loop include a coupling line that fluidly couples at least two of the primary evaporators.

7. The heat transfer system of claim 6, wherein the coupling line and the liquid line are thermally linked.

8. The heat transfer system of claim 1, wherein the condenser comprises:

a housing defining a plurality of channels extending along an axial direction;

wherein the vapor inlet is fluidly coupled to each of the plurality of channels;

wherein the liquid outlet is fluidly coupled to each of the plurality of channels; and a porous structure positioned between at least two channels of the plurality of channels and the liquid outlet and fluidly coupled to the at least two channels of the plurality of channels to the liquid outlet, the porous structure having a pore size large enough to permit liquid to flow from the at least two channels of the plurality of channels through the porous structure to the liquid outlet.

9. The heat transfer system of claim 8, wherein the porous structure of the condenser extends in a direction that is perpendicular to the axial direction.

10. The heat transfer system of claim 8, wherein the porous structure of the condenser extends across all channels of the housing such that the porous structure fluidly couples to all channels.

11. The heat transfer system of claim 8, wherein the porous structure of the condenser is inside the housing.

12. The heat transfer system of claim 8, wherein the porous structure of the condenser has a pore size that is small enough to generate a capillary pressure of a same order of magnitude as a pressure drop across the at least two channels of the plurality of channels defined within the housing.

13. The heat transfer system of claim 1, wherein at least one of the secondary evaporator and the primary evaporators comprises:

an outer enclosure;

a liquid inlet fluidly coupled through the outer enclosure;

a vapor outlet fluidly coupled through the outer enclosure; and a wick within the outer enclosure, fluidly coupled to the liquid inlet, extending along an axial direction, the wick having an outer surface positioned adjacent to the outer enclosure, and comprising:

a plurality of circumferential grooves formed in the outer surface of the wick, the plurality of circumferential grooves extending in a direction that is non-parallel to the axial direction; and a plurality of channels formed in the wick, each channel of the plurality of channels being fluidly connected to the plurality of circumferential grooves, extending along the axial direction of the wick, and being fluidly coupled to the vapor outlet.

14. The heat transfer system of claim 13, wherein the outer surface of the wick contacts the outer enclosure.

15. The heat transfer system of claim 13, wherein the outer surface of the wick has a structure that includes a plurality of protruding portions and a plurality of recessed portions, each circumferential groove of the plurality of circumferential grooves being formed in a space defined between a recessed portion of the plurality of recessed portions, at least two protruding portions of the plurality of protruding portions, and the outer enclosure.

16. The heat transfer system of claim 13, wherein each channel of the plurality of channels extends a length of the wick that is less than a total length of the wick as measured along the axial direction.

17. The heat transfer system of claim 1, wherein at least one of the secondary evaporator and the primary evaporators comprises:

an outer enclosure;

a vapor outlet fluidly coupled through the outer enclosure;

a wick within the outer enclosure, the wick fluidly coupled to the vapor outlet;

an end cap bonded to the outer enclosure, contacting the wick, and having a thermal conductivity that is less than a thermal conductivity of the outer enclosure; and a liquid inlet fluidly coupled through the end cap to the wick.

18. The heat transfer system of claim 1, wherein at least one of the secondary evaporator and the primary evaporators comprises an outer shell;

a vapor outlet fluidly coupled through the outer shell;

a liquid inlet fluidly coupled through the outer shell;

a wick within the outer shell, the wick fluidly coupled to the vapor outlet; and a porous structure positioned between the liquid inlet and the wick, the porous structure thermally isolating the wick from the liquid inlet, having a thermal conductivity that is less than a thermal conductivity of the outer shell, and having pores sized to permit liquid flow, but block vapor flow.

19. The heat transfer system of claim 18, wherein the porous structure includes a liquid distribution groove fluidly coupled to the liquid inlet to receive fluid.

20. A heat transfer system comprising a secondary system comprising:

an evaporator including:

an outer enclosure;

a vapor outlet fluidly coupled through the outer enclosure;

a wick within the outer enclosure and fluidly coupled to the vapor outlet; and a porous structure contacting a surface of the wick and the outer enclosure; and a reservoir including a reservoir casing, and a tube within the reservoir casing that defines a channel that is fluidly coupled to the porous structure of the evaporator;

wherein the porous structure is positioned between the tube and the wick and thermally isolates the surface of the wick from the tube.

21. The system of claim 20, wherein the porous structure is positioned between the wick and a liquid inlet and thermally isolates the surface of the wick from the liquid inlet.

22. The system of claim 20, wherein the porous structure contacts and is positioned within a transition piece that couples the reservoir casing to the outer enclosure of the evaporator.

23. The system of claim 20, wherein the tube includes an end adjacent the porous structure such that slots are defined between the porous structure and the end of the tube, and the slots permit vapor flow from the surface of the wick to an expansion volume of the reservoir.

24. The system of claim 20, wherein the reservoir includes a porous liner along an inner surface of the reservoir and fluidly contacts the tube and the porous structure.

25. The system of claim 20, wherein the tube fluidly couples to a liquid inlet of the reservoir.

26. The system of claim 20, wherein:

the casing of the reservoir includes a first side, a second side, and a linking wall that extends from the first side to the second side; and the evaporator is fluidly coupled to the reservoir at an opening of the first side;

wherein a surface area of the first side is smaller than a surface area of the second side.

27. The system of claim 20, wherein the first side and the second side are configured to permit fluid to flow into the evaporator even though the system is tilted relative to a direction in which a gravitational mass exerts a force on the reservoir.

28. The system of claim 20, wherein the first side and the second side are configured to permit fluid to flow into the evaporator even though the system is tilted relative to a vector of gravitational force.

29. The system of claim 20, wherein the first side and the second side have a circular cross-sectional shape such that the reservoir is conical.

30. The system of claim 20, wherein the evaporator includes an outer enclosure that joins with the casing of the reservoir.

31. The system of claim 20, wherein the evaporator includes a fluid inlet and a vapor outlet, and the reservoir fluidly couples to the fluid inlet.

32. The system of claim 31, wherein the porous structure is adjacent to the fluid inlet, and wherein the wick is fluidly linked to the vapor outlet and is positioned between the vapor outlet and the porous structure.

* * * * *